US009261825B2

(12) United States Patent
Chiyoda

(10) Patent No.: US 9,261,825 B2
(45) Date of Patent: Feb. 16, 2016

(54) IMAGE HEATING APPARATUS HAVING MOVING MECHANISM CONFIGURED TO MOVE A RUBBING ROTATABLE MEMBER CONFIGURED TO RUB A SURFACE OF A ROTATABLE MEMBER, RELATIVE TO THE ROTATABLE MEMBER

(71) Applicant: CANON KABUSHIKI KAISHA, Tokyo (JP)

(72) Inventor: Yasuharu Chiyoda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/325,699

(22) Filed: Jul. 8, 2014

(65) Prior Publication Data

US 2015/0016831 A1 Jan. 15, 2015

(30) Foreign Application Priority Data

Jul. 9, 2013 (JP) ..... 2013-143576

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2028
USPC ..... 399/45, 320, 327
See application file for complete search history.

(56) References Cited

U.S. PATENT DOCUMENTS

| | | | | |
|---|---|---|---|---|
| 7,430,392 | B2 | 9/2008 | Ito et al. | |
| 7,460,821 | B2 * | 12/2008 | Ai et al. | 399/328 |
| 7,962,080 | B2 * | 6/2011 | Kameda | 399/45 |
| 8,917,999 | B2 * | 12/2014 | Takada et al. | 399/320 |
| 2011/0129253 | A1 * | 6/2011 | Takahashi et al. | 399/122 |

* cited by examiner

*Primary Examiner* — William J Royer
(74) *Attorney, Agent, or Firm* — Fitzpatrick, Cella, Harper & Scinto

(57) ABSTRACT

An image heating apparatus includes: first and second rotatable members configured and positioned to form a nip for heating a toner image on a sheet; a rubbing rotatable member configured to rub a surface of the first rotatable member; a moving mechanism configured to move the rubbing rotatable member relative to the first rotatable member between a rubbing position for carrying out a rubbing process for the first rotatable member and a retracted position retracted from the rubbing position; and an executing portion configured to execute the rubbing process in accordance with a number and a kind of the sheet processed by the image heating apparatus.

12 Claims, 10 Drawing Sheets

IMAGE HEATING APPARATUS HAVING MOVING MECHANISM CONFIGURED TO MOVE A RUBBING ROTATABLE MEMBER CONFIGURED TO RUB A SURFACE OF A ROTATABLE MEMBER, RELATIVE TO THE ROTATABLE MEMBER

FIELD OF THE INVENTION AND RELATED ART

The present invention relates to an image heating apparatus which heats a toner image on a sheet of a recording medium.

In the field of an electrophotographic apparatus, it is common practice to use a fixing apparatus (image heating apparatus) to fix a toner image formed on a sheet of a recording medium.

As a fixing apparatus (device) is used to fix a toner image on a sheet of a recording medium, the surface of its fixing member (rotational member), which comes into contact with the sheet, sustains scars (which hereafter may be referred to as "burr scar") which is attributable to the contact between the edges of the sheet and the surface (peripheral surface) of the fixing member. This burr scar worsens as the peripheral surface of the fixing member repeatedly comes into contact with the sheet edge. Thus, in a case where a fixing device is used for fixing a toner image on a sheet of a recording medium which is wider than the sheets of the recording medium which caused sheet edge scars, after its burr scars worsened, it will possibly result in the formation of defective images, the defects of which are attributable to the burr edge scars.

The fixing apparatus disclosed in U.S. Pat. No. 7,430,392 is designed so that as the number of sheets conveyed through its fixing device exceeds a preset value, its refresh roller (rotational rubbing member) is placed in contact with its fixing member to rub the fixation roller to make the surface of the fixing member uniform in roughness.

On the other hand, according to the studies made by the inventors of the present invention, the progression of burr scars is affected by the recording medium type.

Therefore, in the case of a fixing device fixed in the image formation count, which triggers the operation to rub its fixing member, it is possible that the fixing member will be rubbed too frequently or too infrequently, depending on the recording medium type.

SUMMARY OF THE INVENTION

According to an aspect of the present invention, there is provided an image heating apparatus comprising: first and second rotatable members configured and positioned to form a nip for heating a toner image on a sheet; a rubbing rotatable member configured to rub a surface of said first rotatable member; a moving mechanism configured to move said rubbing rotatable member relative to said first rotatable member between a rubbing position for carrying out a rubbing process for said first rotatable member and a retracted position retracted from the rubbing position; and an executing portion configured to execute the rubbing process in accordance with a number and a kind of the sheet processed by said image heating apparatus.

Further features of the present invention will become apparent from the following description of exemplary embodiments (with reference to the attached drawings).

DESCRIPTION OF THE PREFERRED EMBODIMENTS

Hereinafter, the structure of a fixing device as an image heating apparatus (device) is described in detail with reference to the appended drawings. However, prior to the description of the fixing device, a typical image forming apparatus with which the present invention is compatible is described about its general structure.

(Image Forming Apparatus)

Figure 1:
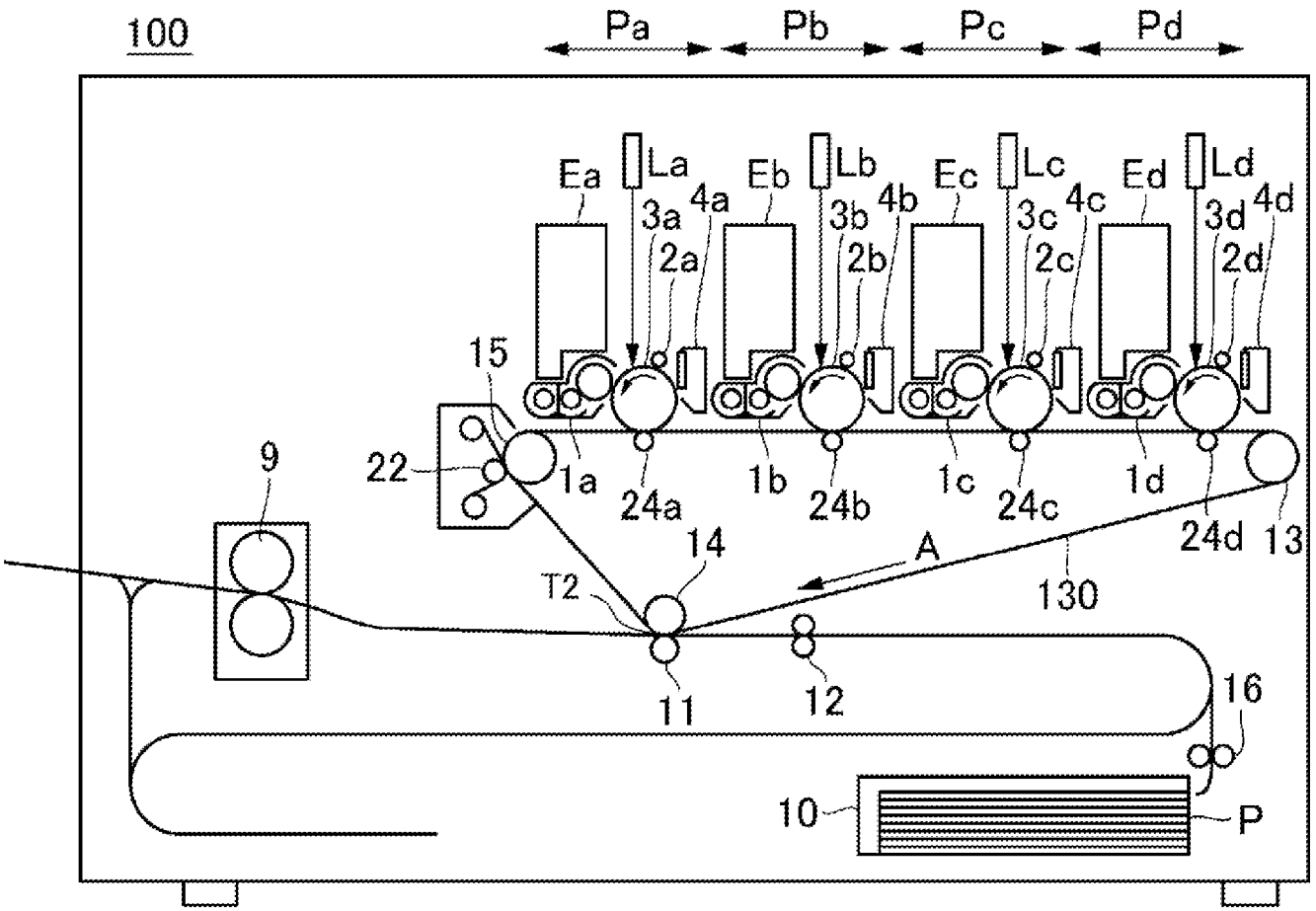
FIG. 1 is a drawing illustrating a typical image forming apparatus with which the present invention is compatible.

FIG. 1 is a drawing illustrating the structure of the image forming apparatus. Referring to FIG. 1, an image forming apparatus 100 is a full-color printer of the so-called tandem type, and also, of the so-called intermediary transfer type. That is, it has image forming portions Pa, Pb, Pc and Pd for forming yellow, magenta, cyan and black toner images, respectively, and an intermediary transfer belt 130, along which the image forming portions Pa, Pb, Pc and Pd are aligned in tandem in the listed order.

In the image forming portion Pa, a yellow toner image is formed on a photosensitive drum 3*a*, and is transferred onto the intermediary transfer belt 130. In the image forming portion Pb, a magenta toner is formed on a photosensitive drum 3*b*, and is transferred onto the intermediary transfer belt 130. In the image forming portions Pc and Pd, cyan and black toner images are formed on photosensitive drums 3*c* and 3*d*, respectively, and are transferred onto the intermediary transfer belt 130.

After being transferred onto the intermediary transfer belt 130, the four toner images, different in color, are conveyed to a secondary transferring portion T2, and transferred (secondary transfer) onto a sheet P of a recording medium. A separation roller 16 pulls out sheets P of a recording medium from a sheet cassette 10 while separating them one by one, and sends each sheet P to a pair of registration rollers 12, which send the sheet P to the secondary transferring portion T2, with such a timing that the sheet P arrives at the secondary transferring portion T2 at the same time as the four toner images on the intermediary transfer belt 130. After the secondary transfer of the four toner images, different in color, from the intermediary transfer belt 130, onto the sheet P, the sheet P is heated by a fixing device 9 to fix the toner images to the sheet P.

The image forming portions Pa, Pb, Pc and Pd are roughly the same in structure, although they are different in the color of the toner used by their developing devices 1*a*, 1*b*, 1*c* and 1*d*, respectively. Hereafter, therefore, only the image forming portion Pa is described; other image forming portions Pb, Pc and Pd are not described in order not to repeat a similar description.

Image forming portion Pa has a charging device 2*a*, an exposing device La, the developing device 1*a*, a transfer roller 24*a*, and a drum cleaning device 4*a*, which are in the adjacencies of the peripheral surface of the photosensitive drum 3*a*. Similarly, the drum cleaning devices 4*b*, 4*c*, and 4*d* perform the same function as the drum cleaning device 4*a* in image forming portions Pb, Pc, and Pd, respectively. And the transfer rollers 24*b*, 24*c*, and 24*d* perform the same function as the transfer roller 24*a* in image forming portions Pb, Pc, and Pd, respectively. The photosensitive drum 3*a* is made up of an aluminum cylinder, and a photosensitive layer formed on the peripheral surface of the aluminum cylinder. The photosensitive drum 3 rotates in the direction indicated by an arrow mark, at a preset process speed.

The charging device 2*a* uniformly and negatively charges the photosensitive drum 3*a* to a preset potential level. The exposing device La writes an electrostatic image on the peripheral surface of the photosensitive drum 3*a*, by scanning, with the use of a rotational mirror, the peripheral surface of the photosensitive drum 3*a* with a beam of laser light the exposing device La outputs, while modulating (turning on or off) the beam with image formation signals obtained by separating the image to be formed, into monochromatic images of primary color. Similarly, the exposing devices Lb, Lc, and Ld perform the same function as the exposing device La in image forming portions Pb, Pc, and Pd, respectively. And similarly, the charging devices 2*b*, 2*c*, and 2*d* perform the same function as the charging device 2*a* in image forming portions Pb, Pc, and Pd, respectively. The developing device 1*a* transfers toner onto the photosensitive drum 3*a* to develop the electrostatic image into a toner image. To the developing device 1*a*, fresh supply of toner is supplied from a toner cartridge Ea, by an amount proportional to the amount by which toner is consumed by the developing device 1*a*. Similarly, the toner cartridges Eb, Ec, and Ed perform the same function as toner cartridge Ea in image forming portions Pb, Pc, and Pd, respectively, except that they contain different colored toner.

The transfer roller 24*a* presses the intermediary transfer belt 130 upon the peripheral surface of the photosensitive drum 3*a*, forming thereby a transferring portion between the photosensitive drum 3*a* and intermediary transfer belt 130. As positive DC voltage is applied to the transfer roller 24*a*, the toner image on the photosensitive drum 3*a*, which is negative in polarity, is transferred onto the intermediary transfer belt 130.

The intermediary transfer belt 130 is suspended, and kept tensioned, by a tension roller 15, an inside secondary transfer roller (belt-backing roller) 14, and a belt driving roller 13. The intermediary transfer belt 130 is rotationally driven by the belt driving roller 13 in the direction indicated by an arrow mark A. An outside secondary transfer roller 11 is placed in contact with the portion of the intermediary transfer belt 130, which is backed by the inside secondary transfer roller 14, forming thereby the secondary transferring portion T2. As positive DC voltage is applied to the outside secondary transfer roller 11, the toner images on the intermediary transfer belt 130 transfer onto the sheet P of a recording medium.

The drum cleaning device 4*a* recovers the transfer residual toner on the photosensitive drum 3*a* by rubbing the photosensitive drum 3*a* with a cleaning blade. A belt cleaning device 22 recovers the transfer residual toner on the intermediary transfer belt 130 by rubbing the intermediary transfer belt 130 with a cleaning web.

Embodiment 1

Figure 2:
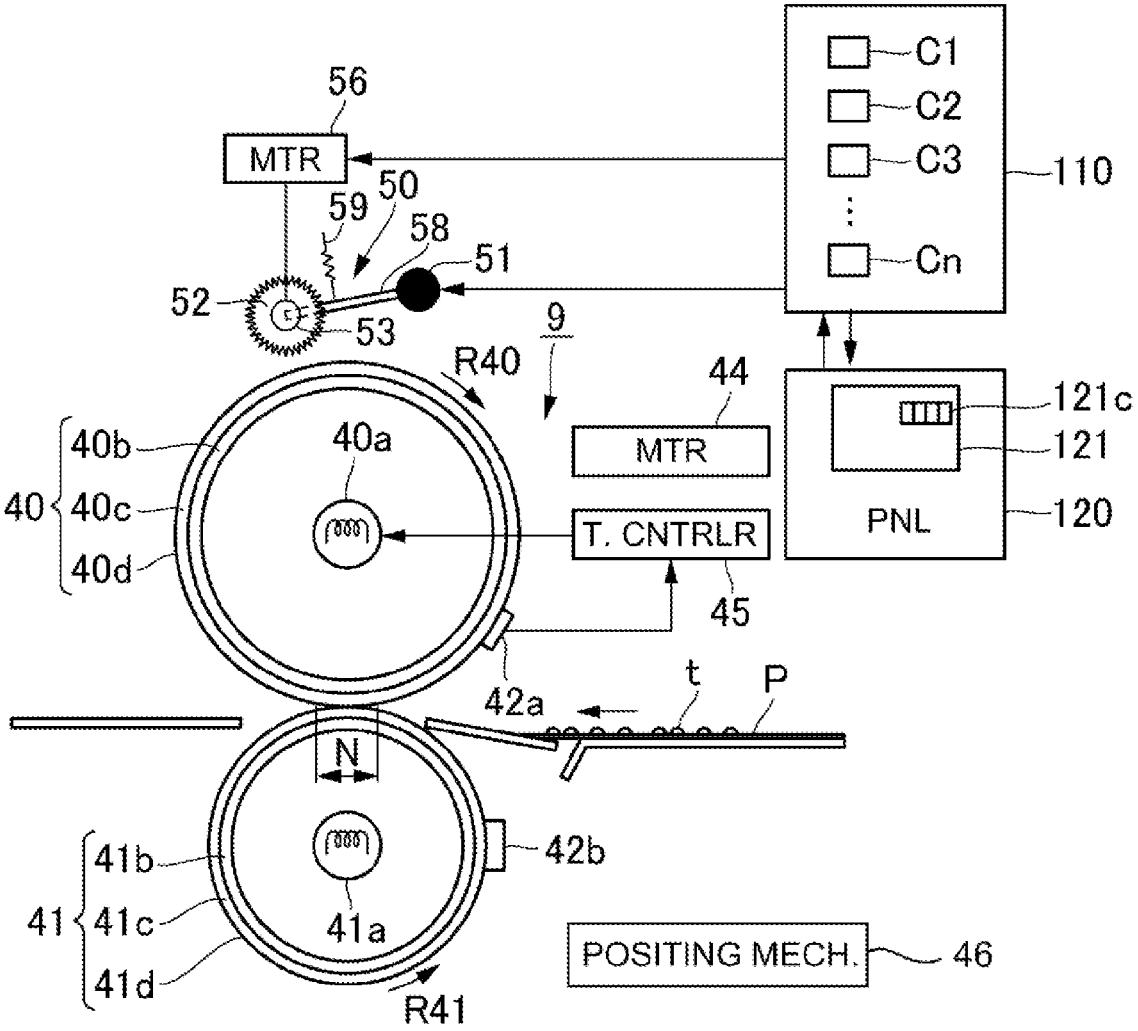
FIG. 2 is a drawing illustrating the structure of a fixing apparatus (device) to which the present invention is applicable.

Referring to FIG. 2, a fixation roller 40 heats a sheet P of a recording medium by being rotated in contact with the sheet P. A refresh roller 52, which is an example of a rotational rubbing member, is disposed so that it can be placed in contact with, or separated from, the fixation roller 40. It is capable of rubbing the peripheral surface of the fixation roller 40. The peripheral surface of the refresh roller 52 is covered with abrasive grain fixed to the peripheral surface. That is, the refresh roller 52 is a roughing roller for roughing the peripheral surface of the fixation roller 40 by being rotationally driven in contact with the peripheral surface of the fixation roller 40, with the provision of a certain amount of difference in peripheral velocity between the refresh roller 52 and fixation roller 40.

A control portion 110, which is an example of an executing portion, is capable of operating the fixing device 9 in a rubbing mode in which the refresh roller 52, which is kept on standby (separated from fixation roller 40) while images are formed, is placed in contact with the fixation roller 40 to make the peripheral surface of the fixation roller 40 as uniform as possible in surface texture, while the fixation roller 40 is rotated.

(Fixing Device)

FIG. 2 is a drawing illustrating the structure of the fixing device 9. Referring to FIG. 2, the fixing device 9, which is an example of an image heating device, has the fixation roller 40 and a pressure roller 41, which form a nip N, through which a sheet P of a recording medium, on which a toner image t is present, is conveyed while remaining pinched by the fixation roller 40 and pressure roller 40, to heat the toner image t.

The fixation roller 40, which is an example of a rotational member, is made up of a substrate 40*b*, and an elastic layer 40*c* formed in a manner to cover the peripheral surface of the substrate 40*b*. The substrate 40*b* is 68 mm in external diameter, and is made of aluminum. The elastic layer 40*c* is 1.0 mm in thickness. It is formed of silicon rubber, which is 20° in hardness (JIS-A, under 1 kg of weight). The surface of the elastic layer 40*c* is covered with a parting layer 40*d*, which is made up of a piece of PFA tube. The parting layer 40*d* is 30 μm in thickness.

The pressure roller 41, which is also an example of a rotational member, is made up of a substrate 41*b*, and an elastic layer 41*c*. The substrate 41*b* is 48 mm in external diameter, and is formed of aluminum. The elastic layer 41*c* is 1.0 mm in thickness and is formed of silicon rubber which is 20° in hardness (JIS-A, under 1 kg of weight). It is formed in a manner to cover the peripheral surface of the substrate 41*b*. The surface of the elastic layer 41*c* is covered with a parting layer 41*d*, which is made up of a piece of tube made of PFA. The parting layer 41*d* is 30 μm in thickness.

The material for the parting layers 40*d* and 41*d* may be PFA resin (copolymer of tetra fluoride ethylene resin, and perfluoroalkoxylethylene resin), or one of other fluorinated resins. The parting layers 40*d* and 41*d* are desired to be no less than 10 μm, and no more than 60 μm, in thickness. The fixation roller 40 is 70 mm in external diameter, and the pressure roller 41 is 50 mm in external diameter.

The lengthwise end portions of the substrate 40*b* of the fixation roller 40, in terms of the direction parallel to the axial line of the fixation roller 40, are rotatably supported by an unshown pair of bearings. The lengthwise end portions of the substrate 41*b* of the pressure roller 41, in terms of the direction parallel to the axial line of the pressure roller 41, are rotatably supported by an unshown pair of bearings. The fixation roller 40 is rotationally driven by a motor 44 (MTR) in the direction indicated by an arrow mark R40 in the drawing. The pressure roller 41 is rotated by the rotation of the fixation roller 40 through an unshown gear train in the direction indicated by an arrow mark R41 in the drawing. The peripheral velocity of the fixation roller 40 and pressure roller 41 is 220 mm/sec, which is equivalent to the process speed (image formation speed) of the image forming apparatus (100 in FIG. 1).

The pressure roller 41 contacts the fixation roller 40, because the pair of bearings, by which the lengthwise end portions of the pressure roller 41 are supported, are under the pressure generated by an unshown pair of compression springs in the direction to press the pressure roller 41 toward the fixation roller 40. The total amount of pressure applied to the lengthwise end portions of the pressure roller 41 by the pair of compression springs to keep the pressure roller 41 in contact with the fixation roller 40 is 800 N. As the pressure roller 41 is pressed upon the fixation roller 40, the elastic layers 40*c* and 41*c* are compressed, forming thereby the nip N, which is preset in width in terms of the direction parallel to the sheet conveyance direction, between the fixation roller 40 and pressure roller 41.

When no sheet P of the recording medium needs to be pinched by the nip N, it is unnecessary for the pressure roller 41 to be pressed upon the fixation roller 40. Thus, when no sheet P needs to be nipped by the nip N, the pressure roller 41 is kept separated from the fixation roller 40 by a pressure roller positioning mechanism 46 (POSITING MECH.). The mechanism 46 (POSITING MECH.) uses a cam mechanism to lower the pressure roller 41 against the above-described unshown pair of compression springs to forcefully separate the pressure roller 41 from the fixation roller 40.

There is disposed a halogen heater 40*a* in the hollow of the fixation roller 40. There is also a temperature sensor 42*a*, which is in contact with the peripheral surface of the fixation roller 40. A temperature control circuit 45 (T. CNTRLR) turns on the halogen heater 40*a* so that the temperature detected by the temperature sensor 42*a* increases to a target level which is in a range of 150-180 degrees, in which the toner t on the sheet P of a recording medium is fixable to the sheet P. Then, it turns off and on the halogen heater 40*a* so that the temperature detected by the temperature sensor 42*a* remains in the range of 150-180 degrees. The target temperature is varied according to type of sheet P.

There is disposed a halogen heater 41*a* in the hollow of the pressure roller 41. There is a temperature sensor 42*b*, which is in contact with the peripheral surface of the pressure roller 41. The temperature control circuit 45 turns on the halogen heater 41*a* so that the temperature detected by the temperature sensor 42*b* increases to a target level which is in a range of 120-150 degrees, in which the toner t on the sheet P of a recording medium does not melt. Then, it turns off and on the halogen heater 41*a* so that the temperature detected by the temperature sensor 42*b* remains in the range of 120-150 degrees.

(Sheet Edge Scar)

Figure 3:
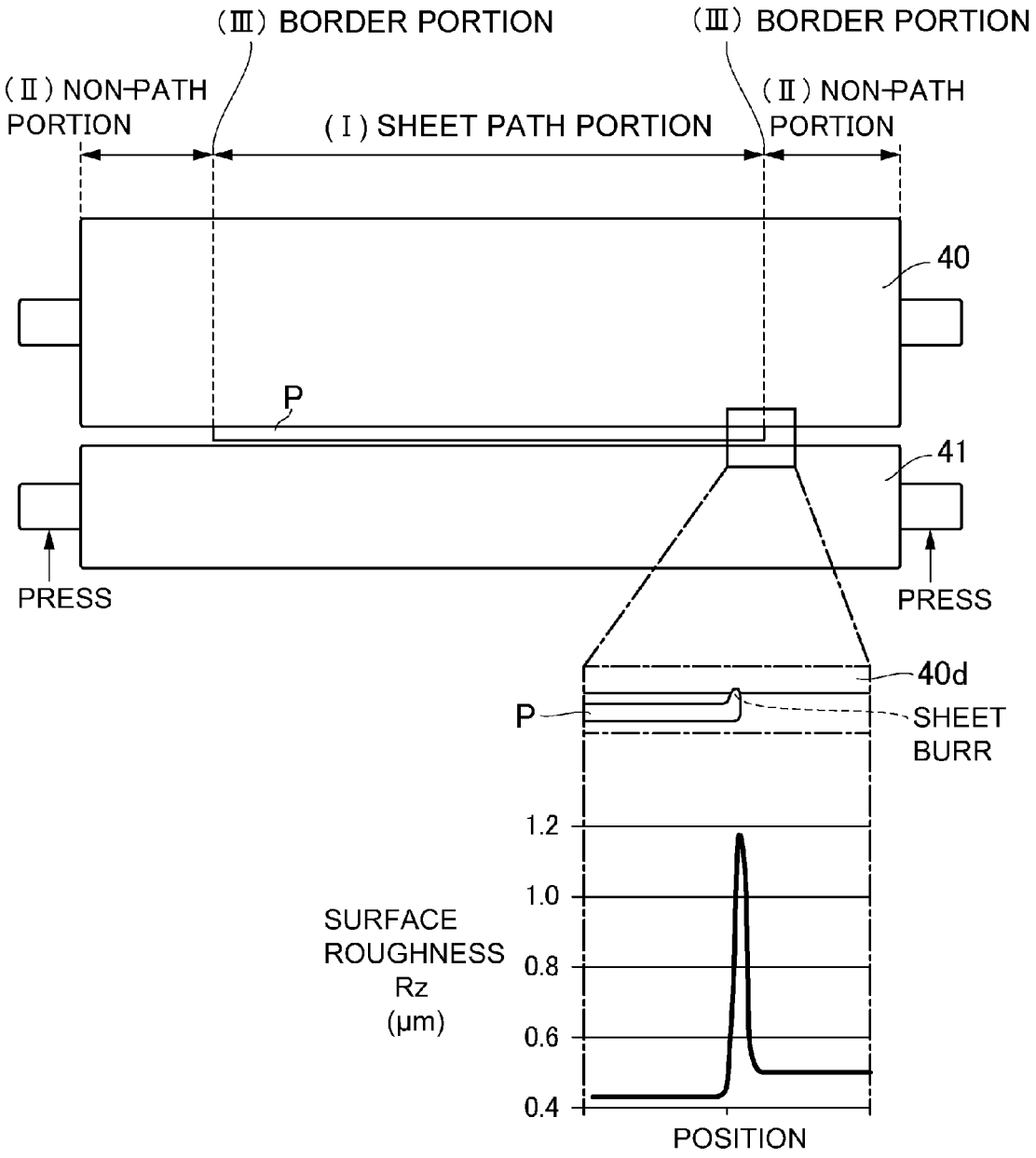
FIG. 3 is a drawing illustrating a fixing device through which a sheet of a recording medium is being conveyed through a fixation nip of the fixing device.
Figure 4:
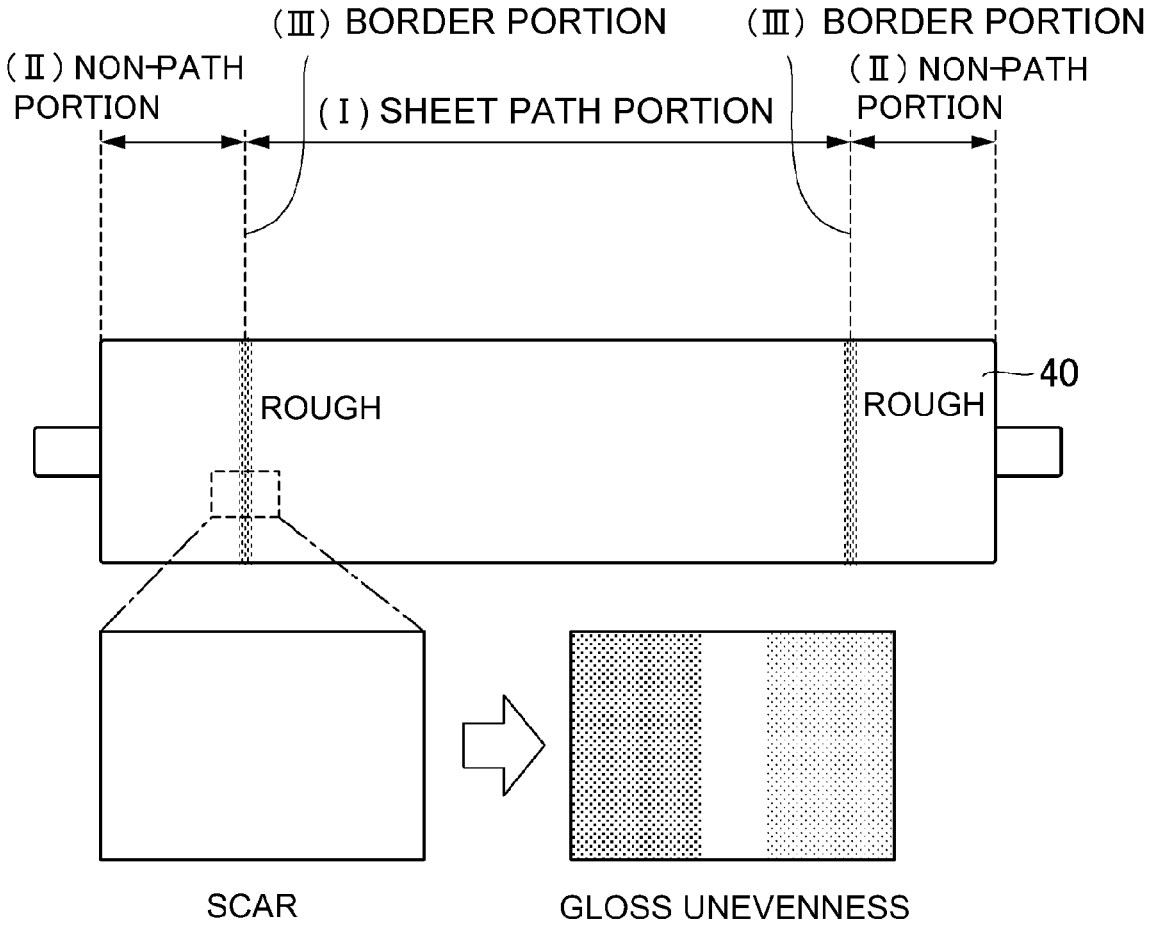
FIG. 4 is a drawing illustrating burr scars.

FIG. 3 is a drawing illustrating the fixing device 9 when a sheet P of a recording medium is being conveyed through the nip N of the fixing device 9, while remaining pinched by the fixation roller 40 and the pressure roller 41. FIG. 4 is a drawing illustrating the burr scar of the fixation roller 40.

Referring to FIG. 2, the fixing device 9 is of the so-called oil-less fixation type. Therefore, unlike a fixing device of the so-called oil-based fixation type, which coats its fixation roller with silicone oil or the like, the fixing device 9 is unlikely to yield images which are non-uniform in gloss, more specifically, is, images suffering from streaks or the like attributable to the oil. Referring to FIG. 1, the image forming apparatus 100 is designed to use easily meltable toner. Thus, the toner satisfactorily melts in the fixing device 9, thereby enabling the toner image surface to become flat and uniform in texture, and therefore, higher in gloss. That is, toner which is easily meltable can form a high quality image, more specifically, highly glossy image, on a sheet of a highly glossy recording medium, such as a sheet of a coated recording medium.

In a case where easily meltable toner is used by an image forming apparatus 100 which employs the fixing device 9 of the oil-less fixation type, the surface texture of the toner image (toner layer) is likely to be easily affected by the surface texture of the fixation roller 40. That is, the surface of the fixed toner image is likely to have microscopic recesses and protrusions embossed thereon by the microscopic protrusions and recesses, respectively, of the peripheral surface of the fixation roller 40. This kind of surface property of a fixed toner image is referred to as reflectivity of a fixed image. As a fixing device (image forming apparatus) is improved in reflectivity of a fixed image by the toner improvement in terms of meltability, it becomes important to maintain the surface texture of the fixation roller 40 in order to form high quality images, more specifically, highly glossy images.

Referring to FIG. 3, when the fixation roller 40 is brand-new, the entirety of its peripheral surface was uniformly reflective like the surface of a mirror, and the surface roughness Rz of the peripheral surface of the fixation roller 40 is in a range of 0.1 μm-0.3 μm. The surface roughness Rz, which will be referred hereafter, is ten-point-average surface roughness (which meets JIS) measured with the use of a surface roughness measuring device SE-3400 (product of Kosaka Laboratory, Ltd., Co.) under such condition that is 0.5 mm/sec in recording medium conveyance speed, 0.8 mm in cutoff, and 2.5 mm in measurement length.

As the cumulative number of sheets of the recording medium conveyed through the fixing device 9 for image fixation (image heating) increases, the peripheral surface of the fixation roller 40 is gradually changed in the state of its peripheral surface (roughed) by its contact with the edges of the sheets of the recording medium, and also, by contaminants such as paper dust, offset toner, and the like. More specifically, as a large number of sheets of the recording number pass through the fixing device 9, in contact with a specific area of the peripheral surface of the fixation roller 40, in terms of the direction parallel to the axial line of the fixation roller 40, the sheet-path portion (I), the out-of-sheet-path portions (II) (NON-PATH PORTION), and the border portions (III) of the peripheral surface of the fixation roller 40 become different in surface roughness.

The sheet path portion (I) contacts the sheets of the recording medium. Thus, it is gradually flattened by its contact with the fiber (of which the recording medium is made), filler, external additives of developer, and the like. As the fixing device 9 increased in the cumulative number of sheets of the recording medium conveyed through the fixing device 9, the surface roughness Rz of the sheet path portion (I) had gradually increased to 0.5 μm-1.0 μm.

The out-of-sheet-path portions (II) of the parting layer 40*d* of fixation roller 40 do not come into contact with sheets of the recording medium. The out-of-sheet-path portions (II) of the parting layer 40*d* contact only the peripheral surface of the pressure roller 41. Thus, as the cumulative number of sheets of the recording medium conveyed through the fixing device 9 increase, the surface roughness Rz of the out-of-sheet-path portions (II) settles roughly in a range of 0.4 μm-0.7 μm.

The border portions (III) which are between the sheet-path portion (I) and out-of-sheet path portions (II), repeatedly come into contact with the lateral edge (edge burr) of a sheet of the recording medium. Thus, they become greater in surface roughness Rz than the sheet-path portion (I). Thus, as the fixing device 9 increased in the cumulative number of sheets conveyed through the fixing device 9, the surface roughness Rz of the border portions (III) becomes greater than that of the sheet-path portion (I). That is, the roughed portions of the peripheral surface of the fixation roller 40, that is, the portions which have non-directional recesses and extend in the circumferential direction of the fixation roller 40 in a manner of encircling the fixation roller 40, had gradually increased in surface roughness Rz, to roughly 0.5 μm-2.0 μm.

Referring to FIG. 4, while an unfixed toner image is fixed to a sheet P of the recording medium, microscopic protrusions and recesses of the peripheral surface of the fixation roller 40 are transferred onto the surface of the toner image. In a case where the sheet-path portion (I) of the fixation roller 40 and the border portions (III) of the fixation roller 40 are different in surface texture (state of surface), the portion of the toner image, which corresponds to the sheet path portion (I), and the portions of the toner image, which correspond to the border portions (III) of the fixation roller 40, become different in surface texture as the toner image is fixed. Thus, the toner image becomes non-uniform in gloss while it is fixed.

The difference in gloss between the portions of the toner image, which correspond to the border portions (III), and the portion of the toner image, which corresponds to the sheet-path portion (I), and the difference in gloss between the portions of the toner image, which correspond to the border portions (III) and the portions of the toner image, which correspond to the out-of-sheet-path portions (II), will be referred to as "burr scar". Further, the gloss difference between the portion of the toner image, which corresponds to the sheet-path portion (I), and the portions of the toner images, which correspond to the out-of-sheet-path portions (II) will be referred to as "gloss level difference". The width of the border portions (III) is in a range of 1-2 mm, being relatively narrow, regardless of the roughness of the border portions (III). Therefore, the gloss level difference between the portion of the toner image, which corresponds to the sheet-path portion (I) and the portions of the toner image, which correspond to the out-of-sheet-path portions (II), is likely to be visually detectable as non-uniformity in gloss, across the wide area of the fixed toner image.

An image which is high in reproducibility in terms of regular reflection is evaluated as being highly glossy. For example, the surface of a silver-salt photograph is virtually free of minute peaks and valleys, being therefore like the surface of a mirror. Thus, as a silver-salt photograph is seen under the illumination by a fluorescent light, not only the light from the fluorescent light is simply reflected by the photograph, but also, the photograph reflects the image of the fluorescent light. The state of reflection of this kind will be deemed high gloss. In comparison, the surface of an image is low in reproducibility in terms of regular reflection, or does not reflect light, it is deemed less glossy. The surface of an image which is very low in reflectiveness has relatively large protrusions and recesses, and therefore, it does not occur that the light from a fluorescent light is regularly reflected. Therefore, it does not occur that the image of the fluorescent light can be seen in the surface of the image. As described above, there is a correlation between the roughness (presence of microscopic protrusions and recesses) of the surface of an image, and the glossiness of the image.

Further, the non-uniformity, in gloss, of a fixed image on a sheet of the recording medium, is affected by the sheet itself (type of sheet). That is, even if a fixed image is such that its non-uniformity in gloss cannot be detected with naked eyes if it is on plain paper, its non-uniformity in gloss will be detectable with naked eyes, that is, it is conspicuous, if it is formed on coated glossy paper which is smoother, higher in gloss, and expected to be higher in image quality. That is, not only the burr scars of the peripheral surface of the fixation roller 40 conspicuously appears as stripes which are lower in gloss, and correspond in position to the border portions (III), but also, areas which are non-uniform in gloss, and correspond in gloss to the portions of the peripheral surface of the fixation roller 40, which is between the sheet-path portion (I) and out-of-sheet-path portions (II). In other words, the fixed image appears non-uniform in gloss even to naked eyes.

As described above, the difference in roughness between sheet-path portion (I) and out-of-sheet-path portions (II) of the fixation roller 40 makes the image forming apparatus output images (fixed images) which are non-uniform in gloss. In particular, the border portions (III) of the fixation roller 40 are easily roughened. Therefore, it becomes different in gloss from both the sheet-path portion (I) and out-of-sheet-path portions (II).

(Refresh Roller)

Figure 5:
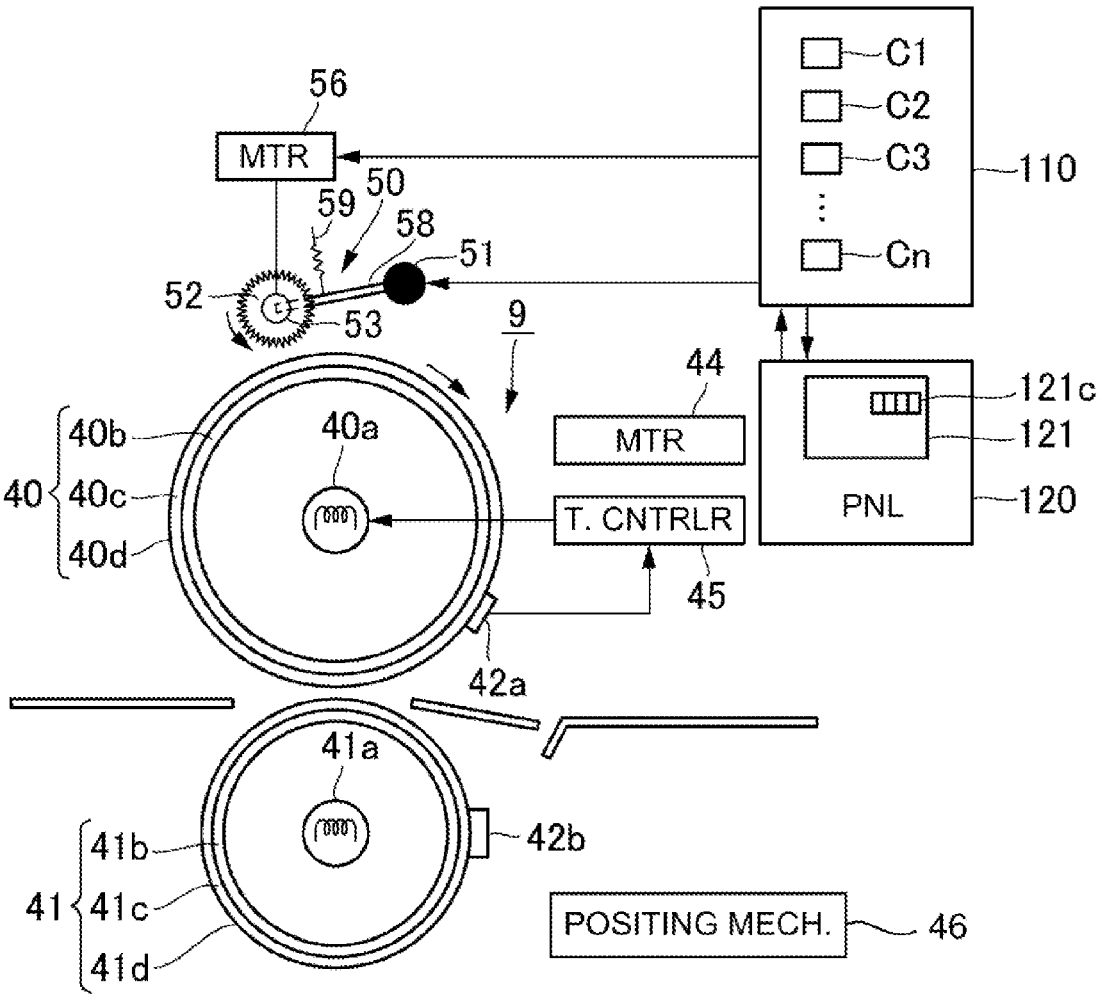
FIG. 5 is a drawing illustrating the positioning and operation of a refresh roller.
Figure 6:
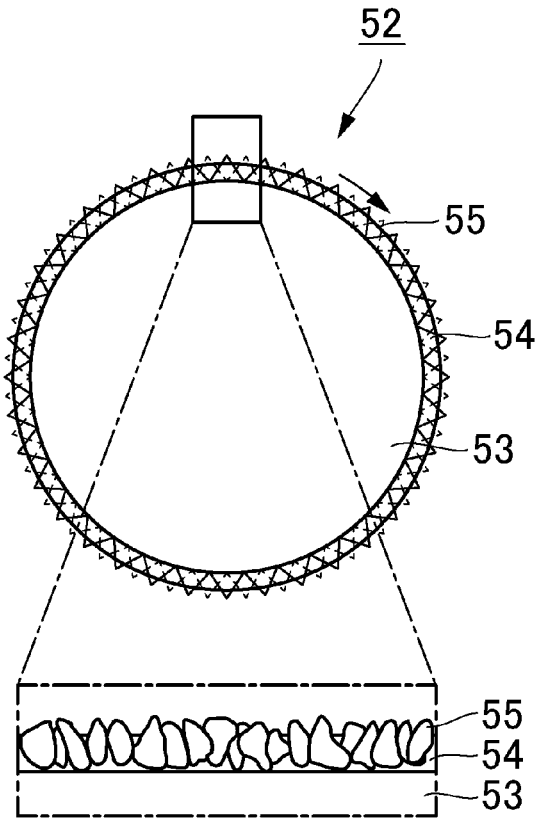
FIG. 6 is a schematic sectional view of the refresh roller, and illustrates the structure of the refresh roller.

FIG. 5 is a drawing illustrating the positioning and operation of the refresh roller 52 (rotational rubbing member). FIG. 6 is a schematic sectional view of the refresh roller 52. FIG. 6 shows the structure of the refresh roller 52.

Referring to FIG. 5, the refresh roller 52 bears a function of restoring the peripheral surface of the fixation roller 40 in texture (function of making peripheral surface of fixation roller 40 uniform in terms of lengthwise direction of fixation roller 40), by being placed in contact with the fixation roller 40 to rub the fixation roller 40, in the rubbing mode.

A motor 56 (MTR) rotationally drives the refresh roller 52 while providing a preset amount of difference in peripheral velocity between the fixation roller 40 and refresh roller 52. The control portion 110 rotates or stops the refresh roller 52 by controlling the motor 56. The direction in which the refresh roller 52 is rotated may be such that the peripheral surface of the refresh roller 52 moves in the area of contact between the refresh roller 52 and fixation roller 40 becomes the same as, or opposite from, the direction in which the peripheral surface of the fixation roller 40 moves in the area of contact.

Next, referring to FIG. 6, the refresh roller 52 is made up of a substrate 53 and an abrasive layer 55. The substrate 53 is a piece of stainless steel pipe (SUS34) which is 12 mm in external diameter. The abrasive layer 55 is formed of abrasive grain adhered to the substrate 53 by an adhesive layer 54.

The abrasive layer 55 can be formed by adhering the various commercial abrasive grain, or a mixture of the various abrasive grains to the peripheral surface of the substrate 53, with the placement of the adhesive layer 54 between the substrate 53 and abrasive layer 55. Some of the examples of commercial abrasive grain are aluminum oxide, aluminum hydroxide, silicon oxide, cerium oxide, titanium oxide, zirconia, lithium silicate, silicon nitrate, silicon carbonate, iron oxide, chrome oxide, antimony oxide, diamond, and the like.

In this embodiment, microscopic grain of aluminum oxide (alumina grain, alundum, molundum) was used as the abrasive grain for the abrasive layer 55. Abrasive grain made of aluminum oxide is the most widely used abrasive grain. It is sufficiently harder than the fixation roller 40, and is excellent in abrasiveness because of its acute edges. Thus, the aluminum oxide grain is excellent as the material for the abrasive layer 55. In order for the abrasive layer 55 to be satisfactory in terms of the post-refreshment surface roughness (texture) of the fixation roller 40, while being able to effectively refresh the peripheral surface of the fixation roller 40, the particle diameter of the abrasive grain for the abrasive layer 55 is desired to be no less than 5 μm and no more than 20 μm, which has been confirmed by experiments.

Referring to FIG. 5, the refresh roller 52 improves the fixation roller 40 in the state of its peripheral surface (peripheral surface texture). The refresh roller 52 makes the peripheral surface of the fixation roller 40 less non-uniform in texture by roughing the peripheral surface of the fixation roller 40 by creating numerous fine abrasions on both the portion of the peripheral surface of the fixation roller 40 roughened by the sheets P of the recording medium, and the portions of the peripheral surface of the fixation roller 40, which have not been roughed by the sheets P.

The objective of the process of rubbing the peripheral surface of the fixation roller 40 with the use of the refresh roller 52 is to create fine abrasions in the peripheral surface of the fixation roller 40. It is not to shave the peripheral surface of the fixation roller 40 to give the fixation roller 40 a brand-new surface. That is, the refresh roller 52 creates abrasions in the peripheral surface of the fixation roller 40 without shaving away virtually any part of the peripheral surface of the fixation roller 40. The extent to which the fixation roller 40 is rubbed by the refresh roller 52 is not so much as to polish the fixation roller 40, but, is more like embossing the peripheral surface of the fixation roller 40 to restore in texture the peripheral surface of the fixation roller 40.

The refresh roller 52 is placed in contact with, or separated from, the fixation roller 40 by an actuator 51 as a refresh roller moving mechanism 50. The refresh roller 52 is rotatably supported by a pair of supporting members 58 located at the lengthwise ends of the substrate 53 in terms of the direction parallel to the axial line of the refresh roller 52. The pair of supporting members 58 is pressed toward the fixation roller 40 by the pressure generated by a pair of compression springs 59 in the direction to press the refresh roller 52 toward the fixation roller 40.

(Rubbing Mode)

Referring to FIG. 2, while images are formed, it is unnecessary for the refresh roller 52 to rub the fixation roller 40. Therefore, the control portion 110 activates the actuator 51 to separate, and keep separated, the refresh roller 52 from the fixation roller 40.

The actuator 51 rotates the supporting members 58 against the force generated by the compression springs 59 to forcefully separate the refresh roller 52 from the fixation roller 40. As the actuator 51 is deactivated, the refresh roller 52 is placed in contact with the fixation roller 40 by the preset amount of force generated by the compression springs 59, and is kept in contact with the fixation roller 40 by the preset amount of force. Thus, a rubbing area, which has a preset dimension in terms of the rotational direction of the fixation roller 40, is formed between the refresh roller 52 and fixation roller 40.

Referring to FIG. 5, in the rubbing mode, the control portion 110 deactivates the actuator 51 to allow the refresh roller 52 to be placed in contact with the fixation roller 40.

It is immediately after the end of an image forming operation that the control portion 110 begins to operate the fixing device 9 in the rubbing mode. In the rubbing mode, the pressure roller 41 is kept separated from the fixation roller 40, and the actuator 51 is deactivated to place the refresh roller 52 in contact with the fixation roller 40.

As the pressure roller 41 separates from the fixation roller 40, the control portion 110 rotates the fixation roller 40 at the same peripheral velocity as the normal peripheral velocity for an image forming operation. It activates also the motor 56 to rotate the refresh roller 52 at such a speed that there will be a preset amount of difference in peripheral velocity between the refresh roller 52 and fixation roller 40.

As the image forming apparatus (fixing device 9) is operated in the rubbing mode for a preset length of time (roughly one minute in this embodiment), the control portion 110 separates the refresh roller 52 from the fixation roller 40 by activating the actuator 51. Then, the control portion 110 stops the motor 56 to stop the rotation of the refresh roller 52.

As the rubbing mode ends, the control portion 110 readies the fixing device 9 for image formation, by activating the positioning mechanism (contact/separation mechanism) 46 to place the pressure roller 41 in contact with the fixation roller 40 to form the nip N.

(Effects of Rubbing Mode)

In the rubbing mode, the refresh roller 52 creates numerous microscopic abrasions (fine directional grooves) which are parallel to the rotational direction of the fixation roller 40, so that the roughness Rz (ten-point-average roughness) of the peripheral surface of the fixation roller 40 becomes no less than 0.5 μm and no more than 2.0 μm. More concretely, the refresh roller 52 rubs the peripheral surface of the fixation roller 40 so that abrasions (fine grooves) which are no more than 10 μm in width are formed in the peripheral surface of the fixation roller 40 by a density of no less than 10 per 100 μm in terms of the direction parallel to the rotational axis of the fixation roller 40.

In the rubbing mode, the peripheral surface of the fixation roller 40 is restored as numerous fine abrasions are created across the entirety of the peripheral surface of the fixation roller 40 by the rubbing of the fixation roller 40 by the refresh roller 52. That is, the difference in texture between the sheet-path portion (I) and out-of-sheet-path portions (II) is eliminated. That is, the difference in surface texture between the sheet-path portion (I) and out-of-sheet-path portions (II) is eliminated, and therefore, the scars of the peripheral surface of the fixation roller 40 become inconspicuous.

In other words, the fixation roller 40 is improved in the condition (texture) of its peripheral surface to such a degree that after the fixation of a toner image, it will be virtually impossible to visually detect the non-uniformity in gloss of the fixed toner image, to the surface of which the texture of the peripheral surface of the fixation roller 40 will have been transferred. Further, the imperfections of the fixed image, which is attributable to the scars of the peripheral surface of the fixation roller 40, will be virtually impossible to detect with naked eyes. Moreover, the stripes which a toner image will have if it is fixed with the fixation roller 40 before the fixation roller restoration, and which correspond in position to the border portion (III), will be virtually nonexistent. Further, the difference in gloss between the portion of the fixed image, which corresponds to the sheet-path portion (I), and the portions of the fixed image, which correspond to the out-of-sheet-path portions (II), will have if a toner image is fixed by the unrestored fixation roller 40, will be inconspicuous.

(Comparative Image Forming Apparatus (Fixing Device))

In the case of the first comparative image forming apparatus, the rubbing mode is a mode selectable by a user. That is, it can be started by a user through a control panel. That is, an operator can start operating the fixing device 9 in the rubbing mode anytime the operator wants. That is, as the image forming apparatus begins to output images which are conspicuously non-uniform in gloss to the operator, the operator can interrupt the on-going image forming operation, and display a menu on the control panel to choose the rubbing mode. As the operator chooses the rubbing mode, the rubbing mode is immediately started to restore the fixation roller 40 in the texture of its peripheral surface.

In the case of the second example of the comparative image forming apparatus, as the number of sheets on which an image was formed exceeds a preset value (500, for example), the control portion 110 of the image forming apparatus 100 automatically starts operating the image forming apparatus 100 in the rubbing mode regardless of the recording medium type. The control portion 110 is provided with a counter for counting the number of sheets on which an image was formed. In an image forming operation which uses sheets P of the recording medium which are smaller in width, in terms of the direction parallel to the rotational axis of the fixation roller 40, than a sheet P of size A3, the control portion 110 increases the value in the counter by one each time an image is formed. As the value in the counter exceeds 500, the control portion 110 temporarily stops the on-going image forming operation, and operates the image forming apparatus 100 in the rubbing mode to restore the fixation roller 40 in the condition of its peripheral surface. Then, it resets the counter.

In the case of the first example of the comparative image forming apparatus, it is not operated in the rubbing mode until the non-uniformity in gloss of a fixed image becomes conspicuous to naked eyes. Therefore, it is possible that the image forming apparatus 100 will begin to be operated in the rubbing mode too late. That is, the timing with which the image forming apparatus 100 is to begin to be operated in the rubbing mode is determined by a human. Thus, this example of comparative image forming apparatus is problematic in that the progression of the scars (abrasions) of the peripheral surface of the fixation roller 40 cannot be accurately grasped.

In the case of the second example of the comparative image forming apparatus 100, the image forming 100 apparatus is operated in the rubbing mode per preset number of sheets of the recording medium on which an image has been formed. Therefore, it can solve to a certain degree the problem which the first example suffers. However, it is operated in the rubbing mode per 500 sheets of the recording medium on which an image has been formed, regardless of sheet type (thickness, brand, and the like). Therefore, it is possible that the image forming apparatus 100 begins to be operated in the rubbing mode long before the image forming apparatus 100 begins to output images which are non-uniform in gloss. That is, it is possible that the image forming apparatus 100 is unnecessarily operated in the rubbing mode.

Here, the amount by which the parting layer 40*d* of the fixation roller 40 is shaved away in the rubbing mode is such an amount that cannot be measured even when the fixation roller 40 has to be replaced due to its deterioration, or falls in the range of measurement error. In the rubbing mode, the parting layer 40*d* of the fixation roller 40 is scarred (abraded) by the refresh roller 52. Therefore, each time the image forming apparatus 100 is operated in the rubbing mode, the fixation roller 40 is surely reduced in the length of its service life. Moreover, when the image forming apparatus 100 is in the rubbing mode, it is prevented from outputting images. That is, the rubbing mode increases the image forming apparatus 100 in downtime, and therefore, it reduces the image forming apparatus 100 in overall rate of operation. Therefore, it is not desired that the image forming apparatus 100 is unnecessarily operated in the rubbing mode.

In the case of the following embodiments of the present invention, sheet type (thickness, brand name, and the like) is taken into consideration to prevent the image forming apparatus 100 from being unnecessarily operated in the rubbing mode. That is, it is ensured that it is immediately before the image forming apparatus 100 begins to output images which are non-uniform in gloss, that the image forming apparatus 100 is operated in the rubbing mode to ensure that the image forming apparatus 100 remains stable in image quality.

(Effects of Sheet Type (Recording Medium Type))

Figure 7:
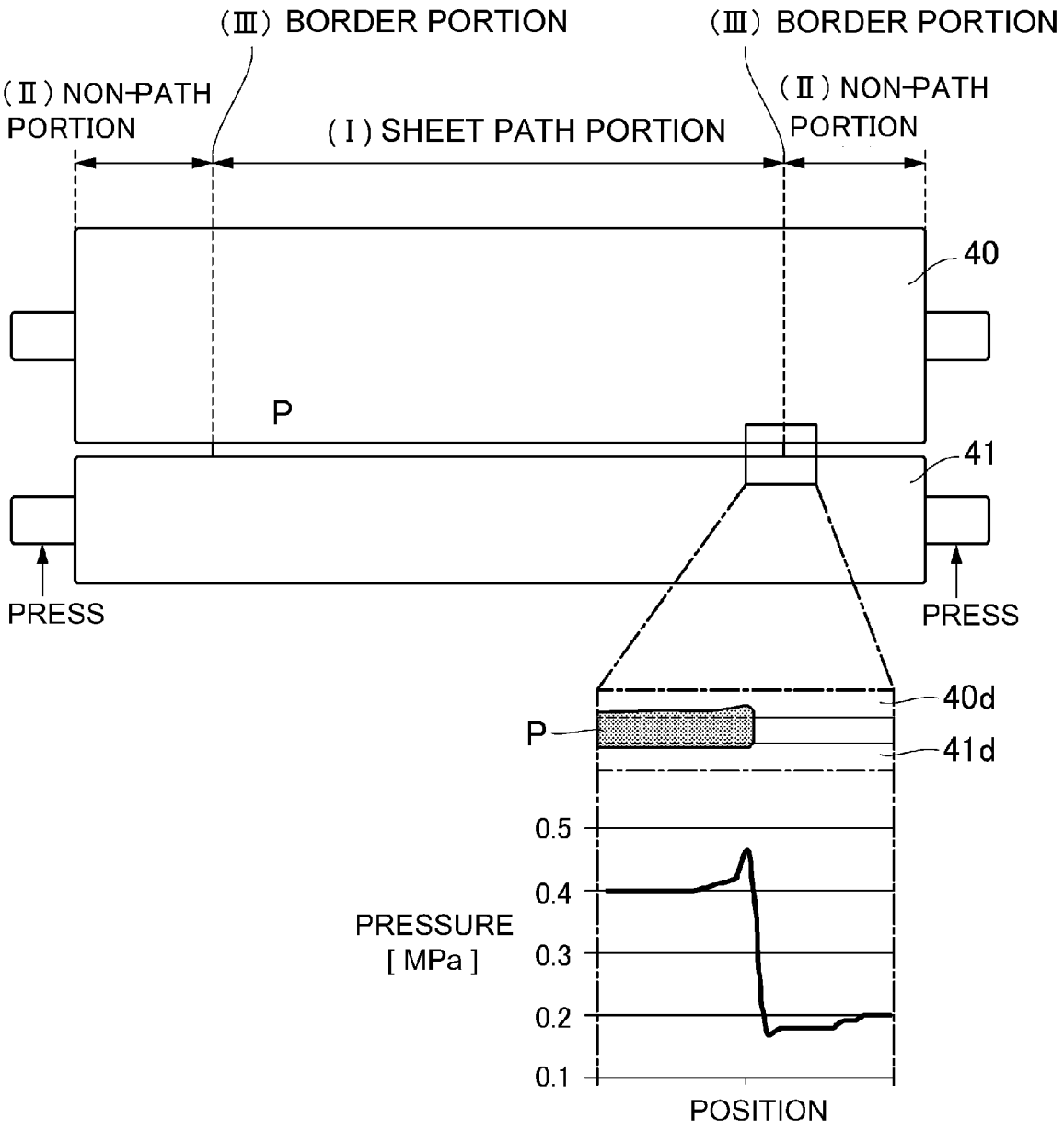
FIG. 7 is a drawing illustrating the state of one of the edges of a sheet of a medium, in the fixation nip of the fixing device.

FIG. 7 is a drawing illustrating the portion of the nip of the fixing device 9, which is in the adjacencies of one of the sheet edges. It shows the state of the portion of the nip.

After the completion of the operation in the rubbing mode, an image is continuously formed on 1000 sheets of the recording medium while varying the sheets in type (thickness, width (length in terms of direction perpendicular to the recording medium conveyance direction)). Then, an image is formed on a sheet of coated glossy paper to examine the fixed image in terms of non-uniformity in gloss to evaluate the fixed image.

TABLE 1

| | | Influence to roller surface | |
|---|---|---|---|
| | | Gloss step | Burr scar |
| Kinds | Plain paper | Low | High |
| | Matte coated | Low | Low |
| | Gloss coated | High | Low |
| Thicknesses | Thin | — | Low |
| | Thick | — | High |
| Widths | Narrow | High | High |
| | Wide | Low | Low |

As will be evident from Table 1, when the recording medium is plain paper, the burr scars of the fixed image are more conspicuous than when the recording medium is coated matte paper, or coated glossy paper. It is reasonable to think that this phenomenon occurs because a sheet of plain paper is greater in the number of edge burrs than a sheet of coated matte paper or coated glossy paper.

Scars attributable to edge burrs are more conspicuous when an image is formed on a sheet of cardstock, which is thick, than when an image is formed on a sheet of thin paper, for the following reason. That is, paper is made up of numerous fibers. Thus, a sheet of paper, which is thicker, and therefore, greater in the number of fibers at its edges, will be greater in burr height, than a sheet of thin paper. In addition, cardstock requires a larger amount of pressure to cut than thin paper. Therefore, burr is more likely to occur when cardstock is cut than when thin paper is cut. The amount of tension to which the fixation roller 40 is subjected when the fixation roller 40 is in contact with the edges of a sheet of cardstock is greater than that to which the fixation roller 40 is subjected when it is in contact with the edges of a sheet of thin paper, even if the two sheets are the same in the number of edge burrs. Therefore, the damage to the peripheral surface of the fixation roller 40 is greater when the recording medium is thick than when thin.

The narrower a sheet of the recording medium (plain paper), the more conspicuous the burr scars of a fixed image. It is reasonable to think that this phenomenon occurs occur because when a sheet of plain paper is wider, the burr scars are outside the sheet path in terms of the direction perpendicular to the recording medium conveyance direction.

The larger the edge burrs which occur when a sheet of the recording medium is cut to a preset size, the more conspicuous the burr scars of a fixed image. The primary cause of the roughing of the peripheral surface of the fixation roller 40 is edge burrs which are parallel to the recording medium conveyance direction. As long as the recording medium used for image formation is a sheet of paper of a brand which is small in burr size, the burr scars of the fixed image are as inconspicuous as those on a sheet of coated glossy paper, even if the recording medium is plain paper.

In order to cut a large sheet of recording paper into a smaller sheet of the recording medium, a sharp cutter is used. However, no matter how sharp a cutter, a certain number of burrs occur along the line of cut. Further, the burrs are more likely to occur as a blade of a cutter became dull due to wear than when the blade is brand-new and sharp. Coated glossy paper and coated matte paper are coated with pigment. Therefore, their fibers are less likely to be disturbed when they are cut. Therefore, burrs are less likely to occur when coated glossy paper, coated matte paper, and the like are cut.

Referring to FIG. 3, as a burr is pinched between the fixation roller 40 and pressure roller 41, the burr makes a minute hole in the peripheral surface of the fixation roller 40. The progression of the roughing of the peripheral surface of the fixation roller 40 is closely related to the surface texture of a sheet of the recording medium, and the pressure between the peripheral surface of the fixation roller 40 and a sheet edge. While a sheet of the recording medium passes through the nip, remaining under the internal pressure of the nip, the sheet edges are pressed upon the parting layer 40*d*. Thus, the parting layer 40*d* gradually changes in surface texture.

Referring to FIG. 4, as a substantial number of sheets of plain paper which are the same in size are continuously heated by the fixing device 9, the aforementioned minute holes concentrate in narrow areas of the peripheral surface of the fixation roller 40, in terms of the direction parallel to the axial line of the fixation roller 40. Thus, these areas of the peripheral surface of the fixation roller 40 are covered with the minute holes, that is, nondirectional scars.

Thus, if a sheet of coated glossy paper, on which a toner image is present, and which is wider than the continuously heated substantial number of sheets of plain paper, is conveyed through the fixing device 9 to be heated, the toner image is subjected to the roughed areas of the peripheral surface of the fixation roller 40. Thus, the image forming apparatus (fixing device 9) outputs an image which suffers from burr scars, that is, an image which is non-uniform in gloss. As the toner image is fixed by the portions of the fixation roller 40, which has a concentration of the aforementioned minutes holes made by the burrs of the edges of the sheets of plain paper, minute protrusions and recesses are formed in the surface of the toner image. Thus, the portions of the toner image, which correspond to the portions of the fixation roller 40, which have the minutes holes, and therefore, have the minute protrusion and recess, become lower in gloss than the portions of the toner image, which correspond to the portions of the fixation roller 40, which do not have the minute protrusions and recesses. Consequently, the image forming apparatus (fixing device 9) outputs a fixed image which suffers from burr scares, that is, an image which is not uniform in gloss. Since the portions of the fixed image, which are low in gloss, extend in the direction parallel to the lateral edges of the sheet, in terms of the recording medium conveyance direction, these portions may sometimes be referred to as image stripes.

While a sheet of the recording medium is conveyed through the nip N of the fixation roller 40, the minute protrusion and recesses of the surface of the sheet are transferred onto the parting layer 40*d* of the sheet-path portion (I) of the peripheral surface of the fixation roller 40. Thus, the parting layer 40*d* gradually increases in roughness. That is, the parting layer 40*d* is roughened. The out-of-sheet-path portions (II) of the peripheral surface of the fixation roller 40 are made rougher by their contact with the pressure roller 41 than when the fixation roller 40 is brand-new.

Referring to FIG. 7, the thicker the sheet of the recording medium used for image formation, the faster the progression of the roughing of the peripheral surface of the fixation roller 40. When sheets of UPM Fine, which is plain paper and is 300 [g/m$^2$], are used as the recording medium, non-uniformity in gloss becomes detectable before burr scars becomes detectable, because UPM Fine cuts easily, and therefore, smaller in the number of edge burrs.

That is, the portion of the nip N, which corresponds to the sheet-path portion (I), becomes higher in internal pressure than the portions of the nip N, which correspond to the out-of-sheet-path portions (II), in proportion to the thickness of the recording medium. Thus, when the recording medium used for image formation is a sheet of plain paper, which is 210 mm in width, and 300 μm in thickness, the highest internal pressure of the nip N is twice as much as the nip pressure while no sheet is conveyed through the nip N. Thus, as roughly 500 sheets of the recording medium are continuously heated by the fixing device 9, the surface roughness of the sheet-path portion (I) of the fixation roller 40 becomes roughly 0.9 μm, whereas the surface roughness of the out-of-sheet-path portions (II) of the peripheral surface of the fixation roller 40 becomes roughly 0.5 μm. Therefore, the difference in roughness between the former and latter is recognized as "difference in gloss" between the sheet-path portion (I) and out-of-sheet-path portions (II) of the peripheral surface of the fixation roller 40.

(Relationship Between Sheet Type and Burr)

Figure 8:
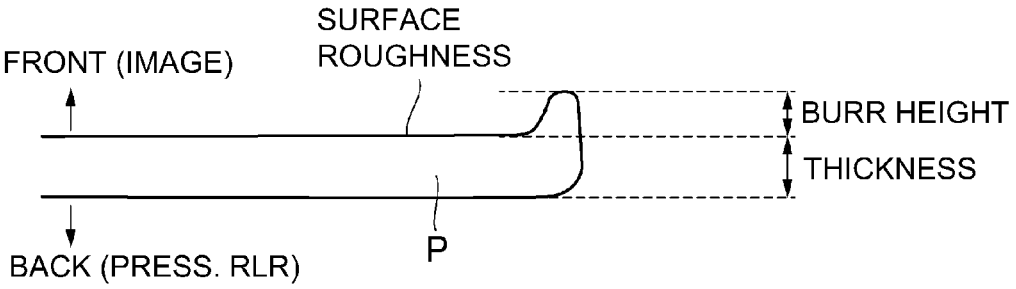
FIG. 8 is an enlarged view of one of the edges of a sheet of a recording medium.
Figure 9:
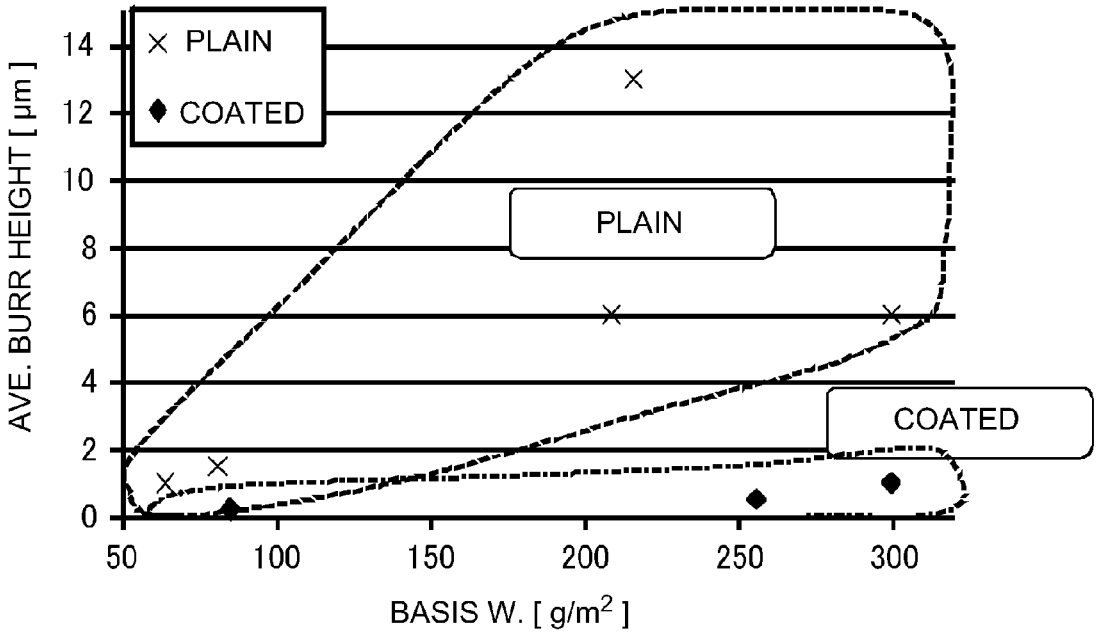
FIG. 9 shows a general pattern of relationships between basis weights and paper kinds and burr heights.

FIG. 8 is an enlarged view of one of the edges of a sheet of the recording medium, and its adjacencies. FIG. 9 is a drawing illustrating the relationship among the basis weight, type, and burr height of a sheet of the recording medium.

Referring to FIG. 8, the burr height is the height of a burr relative to the image bearing surface of a sheet of the recording medium, measured at one of the sheet edges. Sheets of the recording medium which are different in type (plain paper and coated paper) and brand name, and are different in basis weight and thickness, were measured in burr height, and Beck smoothness which indicates the surface roughness of a sheet of the recording medium. That is, plain papers and typical coated paper were measured in basis weight, thickness, Beck smoothness (average value), burr height (average value).

TABLE 2

| Kinds | Tradename | Basis Weight (g/m 2) | Thickness (μm) | Beck smoothness (sec) | Average Burr height (μm) |
|---|---|---|---|---|---|
| Plain paper 1 | GF-640 | 64 | 85 | 40 | 1.0 |
| Plain paper 2 | GF-C081 | 81 | 100 | 80 | 1.5 |
| Plain paper 3 | GF-C209 | 209 | 230 | 70 | 6.0 |
| Plain paper 4 | Hammermil ColorCopy | 216 | 240 | 100 | 13.0 |
| Plain paper 5 | UPM Fine | 300 | 340 | 20 | 6.0 |
| Coated 1 | OK TopCoat+ | 85 | 70 | 1000 | 0.2 |
| Coated 2 | MirrorCoat P | 256 | 270 | 300 | 0.5 |
| Coated 3 | UPM Finesse Gloss | 300 | 320 | 500 | 1.0 |
| Coated 4 | UPM Finesse Silk | 300 | 310 | 100 | 1.0 |

As is evident from Table 2, the sheets were different in burr height. The burr height of some sheets was as high as several micrometers to several tens of micrometers. The greater is a sheet of the recording paper in basis weight, the taller the burrs of the sheet. In a case of plain paper, which is no less than 200 [g/m$^2$] in basis weight, the measured burr height of the sheet is no less than 15 μm. A sheet of coated paper is less in burr height than a sheet of plain paper, and also, is smaller in the amount of paper dust which adheres to the edge surface created by the cutting.

Plain paper and matte paper are greater in Beck smoothness than coated glossy paper. It is reasonable to think that this is attributable to the fact that the lower a sheet of the recording medium in surface roughness, the glossier the sheet.

Referring to FIG. 9, the burrs of plain paper are taller in average height than those of coated paper. Further, the greater in basis weight the recording paper, the greater in average burr height is the recording paper, whether the recording paper is plain or coated.

(Control in First Embodiment)

Figure 10:
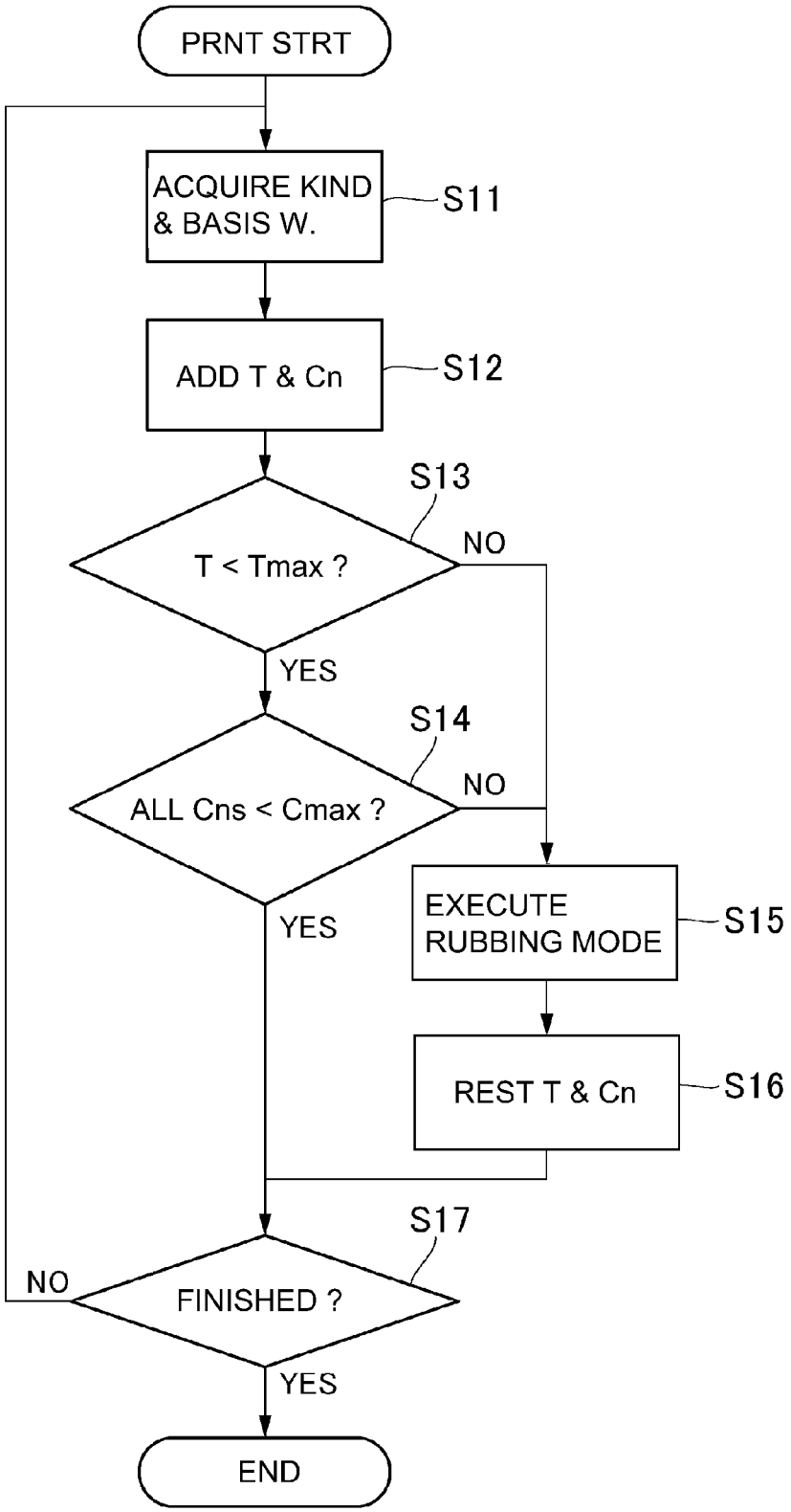
FIG. 10 is a flowchart of a control sequence in a first embodiment of the present invention.

FIG. 10 is a flowchart of a control sequence in the first embodiment. Referring to FIG. 2, the control portion 110 cumulatively counts the heated sheets to determine when it is to begin operating the image forming apparatus (fixing device 9) in rubbing mode, in which the length of time the image forming apparatus is operated in the rubbing mode when the burr height (size) measured at the sheet edge is no more than the first value will be shorter than that when the burr height is the second value which is no less than the first value. That is, the control portion 110 adjusts, continuously or in steps, the length of time the image forming apparatus is operated in the rubbing mode, in such a manner that the taller the edge burrs, the shorter the length of time the image forming apparatus is operated in the rubbing mode, because the taller the edge burrs, the faster the progression of the burr scars. The control portion 110 controls the timing with which it begins to operate the image forming apparatus in the rubbing mode, in such a manner that when the surface roughness of the recording paper has the first value, the length of time the image forming apparatus is operated in the rubbing mode is shorter than when the surface roughness of the recording paper has the second value, because the greater the recording paper in surface roughness, the faster the progression of non-uniformity in gloss.

The control portion 110 controls the rubbing mode start timing in such a manner that the length of time the image forming apparatus is operated in the rubbing mode when the recording medium has a preset first thickness becomes shorter than that when the recording medium has the second thickness which is less than the first thickness, because the thicker the recording medium, the deeper the burr scars regardless of the burr height. Further, the control portion 110 controls the rubbing mode start timing in such a manner that the length of time the image forming apparatus is operated in the rubbing mode when the recording medium is has a preset first basis weight becomes shorter than that when the recording medium has a preset second basis weight which is less than the first basis weight, because the greater in basis weight the recording medium, the deeper the burr scars, even if the recording media are the same in burr height. Further, the control portion 110 controls the rubbing mode start timing in such a manner that the length of time the image forming apparatus is operated in the rubbing mode when the recording medium is has a preset first length in terms of the direction perpendicular to the recording medium conveyance direction becomes shorter than that when the recording medium has a preset second length which is less than the first length, because the shorter the recording medium in terms of the direction perpendicular to the recording medium conveyance direction, the more conspicuous the burr scars, and/or non-uniformity in gloss, in position. The control portion 110 cumulatively counts the heated sheets for each of different types of recording media which are different in the dimension in terms of the direction parallel to the recording medium conveyance direction, and sets the rubbing mode start timing, based on the cumulative count of the heated sheets, because the longer the sheet of the recording medium in terms of the direction parallel to the recording medium conveyance direction, the more the peripheral surface of the fixation roller 40 will be scarred by the edge burrs of the sheet, and therefore, the more conspicuous the non-uniformity in gloss will be.

Referring to Table 3, in the first embodiment, the estimated amount (value) by which the peripheral surface of the fixation roller 40 will be damaged by per sheet of the recording medium when the sheet is heated by the fixing device 9 is used as "count-up value". It is weighted based on the type and basis weight of the recording medium. That is, the estimated amount (value) is set so that the taller the edge burrs, the greater the estimated amount (value).

TABLE 3

| | | Count Up value | |
|---|---|---|---|
| Kinds | Basis weight range (g/m 2) | Passing area counter | Edge counter |
| Plain paper | -79 | 2 | 1 |
| | 80-104 | 2 | 2 |
| | 105-150 | 2 | 3 |
| | 151-209 | 3 | 4 |
| | 210- | 4 | 6 |
| Matte | -79 | 2 | 1 |
| | 80-104 | 2 | 1 |
| | 105-150 | 2 | 1 |
| | 151-209 | 3 | 1 |
| | 210- | 4 | 2 |
| Gloss | -79 | 1 | 1 |
| | 80-104 | 1 | 1 |
| | 105-150 | 1 | 1 |
| | 151-209 | 1 | 1 |
| | 210- | 2 | 2 |

Referring to Table 3, the amount of fixation roller damage per sheet of the recording medium was weighted according to the amount, obtained based on Table 1, by which the non-uniformity in gloss is affected, and the amount, obtained based on Table 2, by which the burr scars are affected.

Referring to FIG. 2, the control portion 110 has multiple edge counters C1, C2, . . . Cn, which correspond to various sheet widths. As a sheet of the recording medium, which is A4 in size, is heated by being conveyed in the landscape attitude through the fixing device 9, or a sheet of the recording medium, which is A3 in size, is heated by being conveyed in the portrait attitude through the fixing device 9, the value in an edge counter C1, which is for a sheet of the recording medium which is 297 mm in width, is increased by a count-up value which corresponds to the type and basis weight of the recording medium in Table 3. As a sheet of the recording medium, which is A4 in size, is heated by being conveyed in the portrait attitude through the fixing device 9, or a sheet of the recording medium, which is A5 in size, is heated by being conveyed in the landscape attitude through the fixing device 9, the value in an edge counter C2, which is for a sheet of the recording medium which is 210 mm in width, is increased by a count-up value which corresponds to the types and basis weights of the recording medium in Table 3. Further, as a sheet of the recording medium, which has the size of a postcard, is heated by being conveyed in the landscape attitude through the fixing device 9, the value in an edge counter C3, which is for a sheet of the recording medium which is 100 mm in width, is increased by a count-up value which corresponds to the types and basis weights of the recording medium in Table 3.

Each time a sheet of the recording medium is heated, the control portion 110 increases the value in the edge counter C1, C2, . . . Cn, by a count-up value which corresponds to the type and basis weight of each sheet, to obtain the cumulative number of heated sheets. Then, as soon as the value in any of the edge counters C1, C2, . . . Cn exceeds a preset referential value, the control portion 110 operates the image forming apparatus in the rubbing mode. Thus, when sheets of the recording medium, which have tall burrs because of its type and basis weight, are used as the recording medium, the control portion 110 begins to operate the image forming apparatus in the rubbing mode while the value in one of the edge counter C1, C2, . . . Cn is relatively small. In comparison, when sheets of the recording medium which are less likely to scar the peripheral surface of the fixation roller 40 with their edge burrs, and therefore, are smaller in the count-up value in Table 3, are used as the recording medium, the image forming apparatus is not operated in the rubbing mode until the value in one of the edge counters C1, C2, . . . Cn becomes substantial.

The control portion 110 has a sheet path area counter T for estimating the amount of non-uniformity in gloss. Each time a sheet of the recording paper is heated, the control portion 110 increases the value in the sheet path area counter T by a count-up value which corresponds to the type and basis weight of the recording paper, in order to obtain the cumulative number of sheets conveyed through the fixing device 9. Then, the control portion 110 operates the image forming apparatus in the rubbing mode as soon as the cumulative value in the sheet path area counter T reaches a preset referential value. Thus, when sheets of the recording paper, which are likely to scar the peripheral surface of the fixation roller 40, and make the peripheral surface of the fixation roller 40 non-uniform in gloss, are used as the recording medium, the image forming apparatus is operated in the rubbing mode while the cumulative value in the sheet path area counter T is relatively small. In comparison, sheets of the recording paper, which are less likely to make the peripheral surface of the fixation roller 40 non-uniform in gloss, are used as the recording medium, the image forming apparatus is not going to be operated in the rubbing mode until the value in the sheet path area counter T becomes substantial, because the sheets are smaller in count-up value in Table 3.

Referring to FIG. 10 along with FIG. 2, each time a sheet of recording paper is heated, the control portion 110 (measuring portion) obtains the type and basis weight of the sheet (S11), and increases the value in one of the edge counters C1, C2, . . . Cn, by the count-up value weighted according to the type and basis weight of the sheet, and also, the value in the sheet path area counter T by the count-up value weighted according to the type and basis weight of the sheet (S12).

If the value in the sheet path area counter T has not reached a preset referential value Tmax (Yes in S13), the control portion 110 decides whether or not the value in one of the edge counters C1, C2, . . . Cn has reached the referential value Cmax (S14).

As the value in the sheet path area counter T reaches the referential value Tmax (No in S13), the control portion 110 operates the image forming apparatus in the rubbing mode (S15). In this embodiment, the referential value Tmax was 2,000 (Tmax=2,000).

AS the value in one of the edge counters C1, C2, . . . Cn reaches the referential value Cmax (No in S14), the control portion 110 operates the image forming apparatus in the rubbing mode (S15). In this embodiment, the referential value Cmax was 2,000 (Cmax=2,000).

In the rubbing mode (S15), the image forming operation (image forming operation to be completed in response to single print command) is interrupted as described above, and the pressure roller 41 is separated from the fixation roller 40 to eliminate the nip N. Then, the refresh roller 52 is made to rub the rotating fixation roller 40. However, it is not mandatory to interrupt the image forming operation to operate the image forming apparatus in the rubbing mode as soon as the value in the counters reaches the referential value. That is, it may be after the completion of the on-going image forming operation that the image forming apparatus is operated in the rubbing mode. That is, all that is necessary is that as the value in the counter reaches the referential value, the image forming apparatus is operated in the rubbing mode.

After the image forming apparatus is operated in the rubbing mode (S15), the control portion 110 resets the edge counters C1, C2, . . . Cn, and the sheet path area counter T (S16).

The control portion 110 operates the image forming apparatus in the rubbing mode (No in S17, S11-S17) as it becomes necessary until the on-going image forming operation is completed (Yes in S17). This operational sequence is carried out for each sheet used for the image forming operation.

(Paper Type 1)

Identical Images were continuously formed on sheets of recording paper UPM Fine (brand name), which were 300 [g/m$^2$] in basis weight and 297 mm in width (size A4), one for one. Referring to Table 3, each time a sheet of recording paper is heated, four points are added to the value in the sheet path area counter T, and six points were added to the value in the edge counter Cn. In this case, as 334 sheets were conveyed through the nip N, the value in the sheet path area counter T became 1,336 (T=1,336), and the value in the edge counter Cn became 2004 (Cn (297 mm)=2,004). Since the value in the edge counter Cn exceeded the referential value Cmax, the image forming apparatus was operated in the rubbing mode.

(Paper Type 2)

In this image forming operation, a combination of a subsequence in which identical images were continuously formed, one for one, on 10 sheets of OK top coat+ (Brand 1), which is 85 [g/m$^2$] in basis weight and 297 mm (size A4) in width, and a subsequence in which an image is formed on one sheet of Upm Finesse Premium Silk (Brand 2), which is 256 [g/m$^2$] in basis weight and 320 mm (size A3) is formed, was repeated. Since these sheets of recording paper were large (no less than 220 in width), the count-up value per sheet was set to a value which is larger by one than the count-up value in Table 3. That is, each time a sheet of Brand 1 was heated, the value in the sheet path area counter T was increased by three points, and the value in the edge counter Cn was increased by three points. Further, each time a sheet of Brand 2 was heated, the value in the sheet path area counter T was increased by five points, and seven points were added to the value in the edge counter Cn. In this experiment (paper type 2), as 716 sheets of Brand 1 and 71 sheets of Brand 2 were heated, the value in the edge counter Cn (297 mm) became 1,432; the value in the edge counter Cn (209 mm) became 1,432; and the value in the sheet path area counter T became 2,000. Since the value in the sheet path area counter T reached the referential value Tmax, the image forming apparatus was operated in the rubbing mode.

Effects of Embodiment 1

According to the control in the first embodiment, in order to restore in surface roughness (texture) the entirety of the peripheral surface of the fixation roller 40 to a preset state, by operating the image forming apparatus in the rubbing mode before the peripheral surface of the fixation roller 40 is significantly scarred by the edge burrs, and is made non-uniform in gloss. Therefore, regardless of the difference in recording papers in terms of type, brand, thickness, width, weight per unit area, it is possible to prevent the problem that as a substantial number of sheets of recording paper, which are the same in type, are continuously heated by a fixing device, the fixing device begins to output images which are non-uniform in gloss. That is, the situation in which the defects of a fixed image, which are attributable to the burr scars of the fixation roller 40, become recognizable, before an image forming apparatus is operated in the rubbing mode, can be avoided. Therefore, it is possible to keep an image forming apparatus high in image quality (quality of fixed image) regardless of recording paper selection.

Also according to the control in the first embodiment, it is possible to finely adjust a fixing device in the fixation condition which is the ultimate determiner of image quality, according to the thickness and surface properties of the recording paper, density and gloss of a fixed image, and the like. Regarding the problems related to the edge burr scar, which varies in seriousness depending on which kind of recording papers are used for image formation, the frequency with which an image forming apparatus is to be operated in the rubbing mode can be adjusted to deal with various sheets of recording papers which are different in size, thickness, surface properties, and the like, in order to maintain the fixation roller 40 in surface properties.

Further, according to the control in the first embodiment, it is possible to minimize the frequency with which an image forming apparatus is operated in the rubbing mode, and therefore, to reduce the downtime which occurs during an image forming operation. Further, it does not occur that an image forming apparatus is unnecessarily operated in the rubbing mode. Therefore, the service life of the refresh roller 52 and the fixation roller 40 are extended. Further, the interval, in terms of sheet count, with which an image forming apparatus is to be operated in the rubbing mode can be extended to 700 sheets or more (roughly three times), whereas in the case of the control sequence for the second comparative image forming apparatus, it has to be operated in the rubbing mode for every 250 sheets (500 images on 500 sheets of size A4). Therefore, it is possible to extend the service life of the fixation roller 40 and the refresh roller 52, and also, to reduce the frequency of the downtime attributable to the operation in the rubbing mode. Further, it is possible to reduce the amount by which the peripheral surface of the fixation roller 40 needs to be made uniform in surface roughness to be restored in surface roughness in the rubbing mode. In other words, it is possible to minimize the difference in the amount by which the peripheral surface of the fixation roller has to be abraded to be made uniform in surface roughness. Therefore, it is unnecessary to afford a large amount of latitude to the length of time the peripheral surface of the peripheral surface of the fixation roller 40 needs to be abraded each time the image forming apparatus is operated in the rubbing mode. In other words, it is possible to minimize the length of time the image forming apparatus needs to be operated in the rubbing mode. Therefore, the amount by which microscopic particles are generated as the parting layer 40*d* of the fixation roller 40 is rubbed by the refresh roller 52 reduces, and therefore, the possibility that foreign substances will enter the interface between the fixation roller 40 and refresh roller 52. Therefore, the possibility that the surface layer of the peripheral surface of the fixation roller 40 will be scarred by the foreign substances reduces.

By the way, in the first embodiment, only one sheet path area counter T was provided. That is, there was no relationship between the number of the sheet path area counters T and the sheet width. However, there may be provided multiple sheet path area counters T1, T2, T3, . . . Tn, which correspond to different sheet widths, like the multiple edge counters C1, C2, . . . Cn, which separately count multiple sheets which are different in width, because the difference in gloss between two areas of a fixed image, which are close to each other, is more conspicuous than that between two areas of a fixed image, which are separated by an area, the gloss of which falls between those of the two areas.

Embodiment 2

Figure 11:
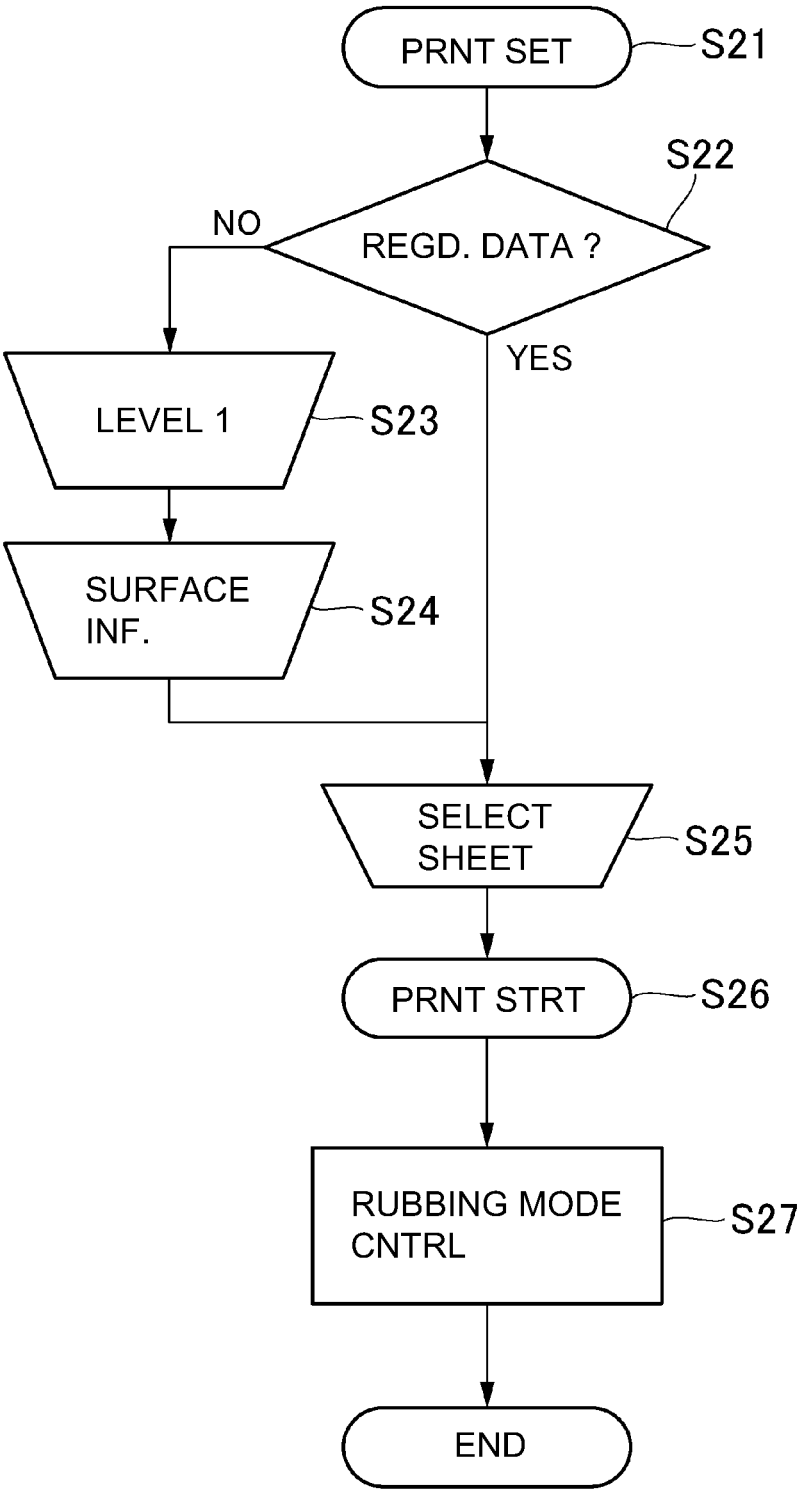
FIG. 11 is a flowchart of a control sequence in a second embodiment of the present invention.

FIG. 11 is a flowchart of a control sequence in the second embodiment of the present invention. In the second embodiment, it is made possible to set the count-up values according to both the brand name of recording paper, and the results of the observation of recording paper by an operator, and/or the results of the evaluation of the fixed image by the operator. In the second embodiment, therefore, it is possible to more properly and finely set the length of time the image forming apparatus is to be operated in the rubbing mode than in the first embodiment.

Referring to FIG. 2, a control panel 120, which is an example of an information inputting means, is usable to input the recording paper type. The control portion 110 which is an example of a part of the recording means, is provided in advance with values which were preset according to the recording medium type, and by which the values in the counters are to be increased per sheet of recording paper. The control portion 110 controls the image forming apparatus according to the recording paper type inputted through the control panel 120, in such a manner that as the cumulative value in the counter reaches a preset threshold value, the image forming apparatus begins to be operated in the rubbing mode.

Values which correspond to the results of the evaluation of sheets of recording paper in term of edge burr, and values which correspond to the results of evaluation of sheets of recording paper in terms of surface roughness, can be inputted with the use of the control panel 120. The control portion 110 is provided with units (numerical values) which were set in advance according to the above-described evaluation of edge burr, and units (numerical values) which were set in advance according to the above-described evaluation of sheets of the recording paper in terms of surface roughness. As the sum of the values which correspond to the evaluation of the recording paper burr reaches the preset threshold value, or the sum of the values which correspond to the evaluation of the recording paper in terms of surface roughness, reaches the preset threshold value, the control portion 110 begins to operate the image forming apparatus in the rubbing mode.

Referring to FIG. 11 along with FIG. 2, prior to the starting of an image forming operation, a user is to input information, such as the brand name of the sheets of recording paper to be used for the image forming operation, with the use of the control panel 120 (S21). Referring to Table 4, the control portion 110 is provided with a table which contains the count-up values, set for each brand, by which the value in the edge counter Cn is to be increased per sheet, and the count-up value, set for each brand, by which the value in the sheet path area counter T is to be increased per sheet.

TABLE 4

| | Count Up value | |
|---|---|---|
| | Passing area counter | Edge counter |
| GF-640 | 1.00 | 0.50 |
| GF-C081 | 1.00 | 0.50 |
| GF-C209 | 1.00 | 2.00 |
| Hammermil ColorCopy | 0.75 | 2.00 |
| UPM Fine | 1.00 | 2.00 |
| OK TopCoat+ | 0.50 | 0.50 |
| MirrorCoat P | 0.50 | 0.50 |
| UPM Finesse Gloss | 0.50 | 0.50 |
| UPM Finesse Silk | 1.00 | 0.50 |

When the brand selected by the operator is in the registered list in Table 4 (Yes in S22), one of the count-up value in the table is used to control the image forming apparatus in the rubbing mode (S25-S27).

When the brand name selected by the operator is not in the list of registered brand names (No in S22), the control portion 110 presents a table, for example, Table 5, on a display portion (121*c* in FIG. 2) of the control panel 120, to prompt the operation to manually input the information.

TABLE 5

| Settings | Burr height | Surface roughness | Count Up value |
|---|---|---|---|
| 5 | Large | Rough | 2.00 |
| 4 | ↑ | ↑ | 1.50 |
| 3 | | | 1.00 |
| 2 | ↓ | ↓ | 0.75 |
| 1 | Small | Smooth | 0.50 |

Referring to Table 5, the table is provided with a column which contains burr height and is for inputting the burr height. The operator is to set the burr height to one of five choices 1 (low)-5 (high) (S23).

Referring to Table 5, the table on a display 121 is provided with a surface property column for inputting the surface property of the recording paper. Thus, it is possible for the operator to choose one of the surface property levels 1 (flat and smooth)-5 (rough) (S24), according to the results of visual observation, or the like.

The control portion 110 sets count-up value for the edge counter Cn, as shown in Table 4, according to the burr level set by the operator (S25). Further, the control portion 110 sets the count-up value for the sheet path area counter T, as shown in Table 4, according to the surface property level set by the operator (S25).

As the operator gives an image formation start command (S26), the control portion 110 begins to control the image forming apparatus so that the apparatus is operated, as necessary, in the rubbing mode (S27).

Referring to FIG. 10 along with FIG. 2, each time the image forming apparatus is operated in the rubbing mode, the control portion 110 resets the edge counter Cn and sheet path area counter T (S16). Then, as the value in the sheet path area counter T reaches the referential value Tmax (No in S13), or the value in the edge counter Cn reaches the referential value Cmax (No in S14), the control portion 110 operates the image forming apparatus in the rubbing mode (S15).

Effects of Embodiment 2

In the second embodiment, information such as burr height, surface properties, and the like, are included in the list which is to be used by a user to set the count-up values. Therefore, the frequency with the image forming apparatus is to be operated in the rubbing mode can be weighted, based on the brand name of the sheets of the recording paper, as in the first embodiment.

In the second embodiment, information such as burr height, surface properties, and the like, of the recording paper is internally held by the image forming apparatus. Therefore, the frequency with which the image forming apparatus is to be operated in the rubbing mode during a given image forming operation, is set in consideration of the column which contains "burr amount" and the column which contains "surface property information", after the selection of the recording paper.

The frequency with which the image forming apparatus is to be operated in the rubbing mode is made changeable within a range of ½-twice. Therefore, the count-up values can be set to match the recording paper properties.

The information input table on the display 121 of the control panel 120 may be modified so that raw data, such as the measured height of burrs, the measured surface roughness of the recording paper, can be inputted, instead of the value which represents estimated burr height and/estimated surface roughness. The sheet passage of the image forming apparatus may be provided with devices for measuring a sheet of the recording paper in burr height and/or surface properties, so that the burr height and surface roughness can be obtained realtime.

<Miscellanies>

The present invention is applicable to image forming apparatuses which employ a fixing device, and which are partially or entirely different in structure from those in the preceding embodiments, as long as they are structured so that the intervals (the recording medium sheet count) with which they are operated in the rubbing mode is automatically changed according to the progression of the roughing of the peripheral surface of their rotational member. The measurements, materials, shapes, of the structural components of the image forming apparatuses in the first and second embodiments, and the positional relationship among the structural components, are not intended to limit the present invention in scope, unless specifically noted. In this specification, only the portions of the image forming apparatus, which are related to the formation and transfer of a toner image, are described. However, the present invention is compatible with various image forming apparatuses other than those in the preceding embodiments. For example, it is compatible with various printers, copying machines, facsimile machines, multifunction image forming apparatuses, which are combination of one of the image forming apparatuses in the preceding embodiments, and additional devices, equipment, casings, and the like.

The image forming apparatuses may be structured so that sheet type can be automatically identified by a sheet type identifying device, which is an example of an identifying means. In such a case, the control portion 110 can control the timing with which the image forming apparatus begins to be operated in the rubbing mode, according to the recording paper type identified by the recording paper type identifying device. One of the examples of the recording paper type identifying device is a thickness sensor.

The rotational member does not need to be a roller. For example, it may be a belt. Further, the rotational member does not need to be a fixing member. For example, it may be a heating member, a pressing member, or the like. The traces of the scars made in the peripheral surface of the fixation roller 40 by the edge burrs of a sheet of the recording paper manifests on the fixed image as a smaller sheet of the recording paper is replaced with a larger sheet of the recording paper. Therefore, when a sheet of the recording paper used for image formation is of the largest size, it is unnecessary to count the sheets. It is not mandatory that the refresh roller 52 is driven by a dedicated driving means. For example, driving force may be transmitted to the means for driving the fixation roller 40 so that the refresh roller 52 is rotationally driven, with the presence of difference in peripheral velocity between the refresh roller 52 and fixation roller 40. Further, the fixation roller 40 and refresh roller 52 may be in connection to each other through a gear train which is one to two in gear ratio, so that the refresh roller 52 is rotated at twice the peripheral velocity of the fixation roller 40.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 143576/2013 filed Jul. 9, 2013, which is hereby incorporated by reference.

What is claimed is:

1. An image heating apparatus comprising:

first and second rotatable members configured and positioned to form a nip for heating a toner image on a sheet;

a rubbing rotatable member configured to rub a surface of said first rotatable member;

a moving mechanism configured to move said rubbing rotatable member relative to said first rotatable member between a rubbing position for carrying out a rubbing process for said first rotatable member and a retracted position retracted from the rubbing position; and an executing portion configured to execute the rubbing process in accordance with the number and burrs of the sheets processed by said image heating apparatus.

2. An apparatus according to claim 1, further comprising an input portion configured to input information corresponding to a kind of the sheet to be processed by said image heating apparatus, and a counter configured to count the number of the sheets processed by said image heating apparatus, wherein said executing portion executes the rubbing process in accordance with the outputs of said counter and said input portion.

3. An apparatus according to claim 2, wherein said counter resets a count of said counter in response to the execution of the rubbing process.

4. An apparatus according to claim 1, wherein said executing portion executes the rubbing process when a heating process of said image heating apparatus is not executed.

5. An image heating apparatus comprising:

first and second rotatable members configured and positioned to form a nip for heating a toner image on a sheet;

a rubbing rotatable member configured to rub a surface of said first rotatable member;

a moving mechanism configured to move said rubbing rotatable member relative to said first rotatable member between a rubbing position for carrying out a rubbing process for said first rotatable member and a retracted position retracted from the rubbing position;

a counter configured to count the number of the sheets processed by said image heating apparatus; and an executing portion configured to execute the rubbing process in accordance with an output of said counter, wherein said executing portion executes the rubbing process in response to an event of the execution of a continuous image heating process of said image heating apparatus on a first number of first sheets, and executes the rubbing process in response to an event of the execution of a continuous image heating process of said image heating apparatus on a second number of second sheets having a thickness larger than that of the first sheets, the second number being smaller than the first number.

6. An image heating apparatus comprising:

first and second rotatable members configured and positioned to form a nip for heating a toner image on a sheet;

a rubbing rotatable member configured to rub a surface of said first rotatable member;

a moving mechanism configured to move said rubbing rotatable member relative to said first rotatable member between a rubbing position for carrying out a rubbing process for said first rotatable member and a retracted position retracted from the rubbing position;

a counter configured to count a number of the sheets processed by said image heating apparatus; and an executing portion configured to execute the rubbing process in accordance with an output of said counter, wherein said executing portion executes the rubbing process in response to an event of the execution of a continuous image heating process of said image heating apparatus on a first number of first sheets, and executes the rubbing process in response to an event of the execution of a continuous image heating process of said image heating apparatus on a second number of second sheets having a basis weight larger than that of the first sheets, the second number being smaller than the first number.

7. An image heating apparatus comprising:

first and second rotatable members configured and positioned to form a nip for heating a toner image on a sheet;

a rubbing rotatable member configured to rub a surface of said first rotatable member;

a moving mechanism configured to move said rubbing rotatable member relative to said first rotatable member between a rubbing position for carrying out a rubbing process for said first rotatable member and a retracted position retracted from the rubbing position;

a counter configured to count a number of the sheets processed by said image heating apparatus; and an executing portion configured to execute the rubbing process in accordance with an output of said counter, wherein said executing portion executes the rubbing process in response to an event of the execution of a continuous image heating process of said image heating apparatus on a first number of first sheets, and executes the rubbing process in response to an event of the execution of a continuous image heating process of said image heating apparatus on a second number of second sheets having a burr larger than that of the first sheets, the second number being smaller than the first number.

8. An image heating apparatus comprising:

first and second rotatable members configured and positioned to form a nip for heating a toner image on a sheet;

a rubbing rotatable member configured to rub a surface of said first rotatable member;

a moving mechanism configured to move said rubbing rotatable member relative to said first rotatable member between a rubbing position for carrying out a rubbing process for said first rotatable member and a retracted position retracted from the rubbing position;

a counter configured to count a number of the sheets processed by said image heating apparatus; and an executing portion configured to execute the rubbing process in accordance with an output of said counter, wherein said executing portion executes the rubbing process in response to an event of the execution of a continuous image heating process of said image heating apparatus on a first number of first sheets, and executes the rubbing process in response to an event of the execution of a continuous image heating process of said image heating apparatus on a second number of second sheets having a surface roughness larger than that of the first sheets, the second number being smaller than the first number.

9. An image heating apparatus comprising:

first and second rotatable members configured and positioned to form a nip for heating a toner image on a sheet;

a rubbing rotatable member configured to rub a surface of said first rotatable member;

a moving mechanism configured to move said rubbing rotatable member relative to said first rotatable member between a rubbing position for carrying out a rubbing process for said first rotatable member and a retracted position retracted from the rubbing position; and an executing portion configured to execute the rubbing process in accordance with the number and surface roughnesses of the sheets processed by said image heating apparatus.

10. An apparatus according to claim 9, further comprising an input portion configured to input information corresponding to a kind of the sheet to be processed by said image heating apparatus, and a counter configured to count the number of the sheets processed by said image heating apparatus, wherein said executing portion executes the rubbing process in accordance with the outputs of said counter and said input portion.

11. An apparatus according to claim 10, wherein said counter resets a count of said counter in response to the execution of the rubbing process.

12. An apparatus according to claim 9, wherein said executing portion executes the rubbing process when a heating process of said image heating apparatus is not executed.

* * * * *